US012123199B1

(12) United States Patent
Kenny et al.

(10) Patent No.: US 12,123,199 B1
(45) Date of Patent: Oct. 22, 2024

(54) PANEL ASSEMBLY

(71) Applicant: Jeffrey S. Kenny, Fort Worth, TX (US)

(72) Inventors: Jeffrey S. Kenny, Fort Worth, TX (US); Curtis Herron, Fort Worth, TX (US); Ben Davis, Azle, TX (US); Peter Bixby, North Richland Hills, TX (US)

( * ) Notice: Subject to any disclaimer, the term of this patent is extended or adjusted under 35 U.S.C. 154(b) by 0 days.

(21) Appl. No.: 17/372,831

(22) Filed: Jul. 12, 2021

Related U.S. Application Data

(63) Continuation-in-part of application No. 17/029,774, filed on Sep. 23, 2020, now Pat. No. 11,313,135.

(51) Int. Cl.
*E04F 13/08* (2006.01)
*E04F 13/12* (2006.01)

(52) U.S. Cl.
CPC ..... *E04F 13/0826* (2013.01); *E04F 13/081* (2013.01); *E04F 13/0894* (2013.01); *E04F 13/12* (2013.01); *E04F 2201/0107* (2013.01); *E04F 2201/023* (2013.01); *E04F 2201/043* (2013.01)

(58) Field of Classification Search
CPC ..... E04F 13/0894; E04F 13/081; E04F 13/12; E04F 13/0733; E04F 2201/043; E04F 2201/0107; E04F 2201/023; E04F 13/0826
See application file for complete search history.

(56) References Cited

U.S. PATENT DOCUMENTS 3,291,437 A * 12/1966 Bowden ..... E04G 13/021 220/4.16
3,301,147 A * 1/1967 Clayton ..... E01C 9/083 404/35
3,376,683 A 4/1968 Epstein
3,588,027 A 6/1971 Bowden
3,858,377 A 1/1975 Browne
4,484,427 A * 11/1984 Crites ..... E04F 13/0805 52/261
4,603,068 A 7/1986 Hunter
5,187,843 A * 2/1993 Lynch ..... F16B 5/0016 24/453
5,608,999 A 3/1997 McNamara
5,735,090 A 4/1998 Papke
5,740,648 A 4/1998 Piccone
(Continued)

FOREIGN PATENT DOCUMENTS

CA 2943642 A1 10/2015
CA 3008915 A1 7/2017
(Continued)

OTHER PUBLICATIONS

Final Office Action dated Nov. 12, 2021 from U.S. Appl. No. 17/029,774.
(Continued)

*Primary Examiner* — Jessie T Fonseca
(74) *Attorney, Agent, or Firm* — James E. Walton

(57) ABSTRACT

An end cap for a panel support of a panel assembly comprising an exposed surface and a side surface. The exposed surface of the end cap has opposing edges, and the exposed surface forms a selected end effect. The side surface has at least one fastener hole. The edges of the exposed surface of the end cap are configured to mate with an end surface of the panel support.

18 Claims, 20 Drawing Sheets

(56) References Cited

U.S. PATENT DOCUMENTS

| | | | | |
|---|---|---|---|---|
| 6,167,669 | B1 * | 1/2001 | Lanc | E04B 2/8641 52/439 |
| 6,212,845 | B1 | 4/2001 | De Zen | |
| 6,219,984 | B1 | 4/2001 | Piccone | |
| 6,247,280 | B1 | 6/2001 | Grinshpun | |
| 6,435,471 | B1 | 8/2002 | Piccone | |
| 8,333,291 | B2 * | 12/2012 | Rosendahl | H01R 13/506 220/691 |
| 9,315,987 | B2 * | 4/2016 | Richardson | E04G 23/0218 |
| 9,453,345 | B2 | 9/2016 | Richardson | |
| 10,087,639 | B1 * | 10/2018 | Simonsen | E04F 13/12 |
| 10,407,895 | B2 | 9/2019 | Krohmer | |
| 2003/0009967 | A1 | 1/2003 | Piccone | |
| 2003/0019171 | A1 * | 1/2003 | Thibault | E04F 15/10 52/592.1 |
| 2004/0010994 | A1 | 1/2004 | Piccone | |
| 2005/0016083 | A1 | 1/2005 | Morin | |
| 2005/0016103 | A1 | 1/2005 | Piccone | |
| 2005/0053429 | A1 | 3/2005 | Davidsaver | |
| 2006/0005497 | A1 | 1/2006 | Foell | |
| 2006/0032172 | A1 | 2/2006 | Foell | |
| 2006/0168855 | A1 | 8/2006 | D'Urban Jackson | |
| 2006/0185270 | A1 | 8/2006 | Handley | |
| 2006/0288651 | A1 * | 12/2006 | Zeng | E04F 15/02194 52/177 |
| 2010/0251657 | A1 | 10/2010 | Richardson | |
| 2011/0120037 | A1 * | 5/2011 | Barlow | E04F 15/105 52/309.1 |
| 2011/0134651 | A1 * | 6/2011 | Berman | F21S 8/02 362/365 |
| 2012/0014745 | A1 | 1/2012 | Rosendahl | |
| 2012/0056344 | A1 | 3/2012 | Richardson | |
| 2014/0367056 | A1 | 12/2014 | Miller | |
| 2016/0326749 | A1 * | 11/2016 | Johnson | E04F 13/0846 |
| 2016/0376799 | A1 | 12/2016 | Richardson | |
| 2018/0058063 | A1 | 3/2018 | Delfino | |
| 2021/0102382 | A1 | 4/2021 | Shaw | |

FOREIGN PATENT DOCUMENTS

| | | | |
|---|---|---|---|
| DE | 202018107451 | U1 | 3/2019 |
| DE | 102019112177 | B3 | 9/2020 |
| WO | 2013188980 | A1 | 12/2013 |
| WO | 2020006601 | A1 | 1/2020 |

OTHER PUBLICATIONS

Office Action dated Jun. 24, 2021 from U.S. Appl. No. 17/029,774.

* cited by examiner

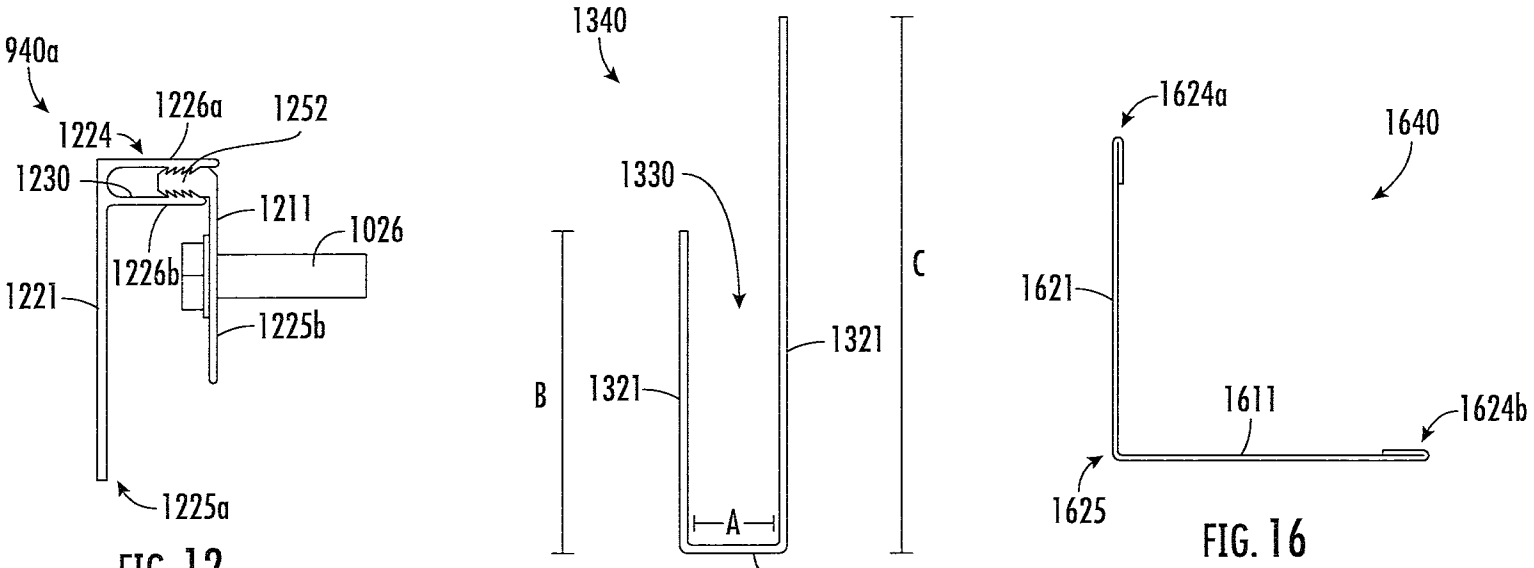
FIG. 16
FIG. 13
FIG. 12
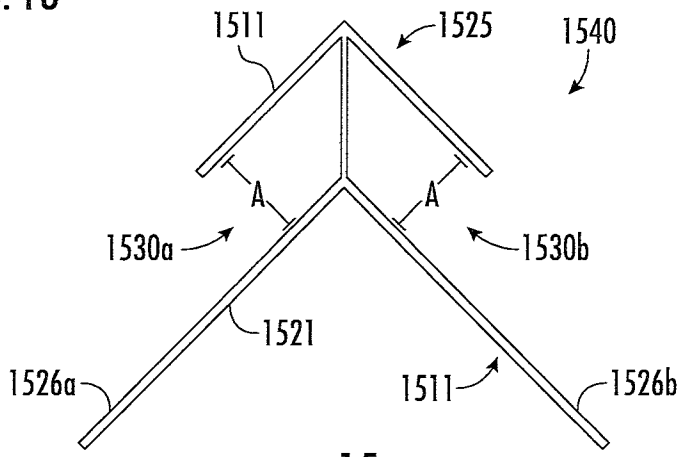
FIG 15
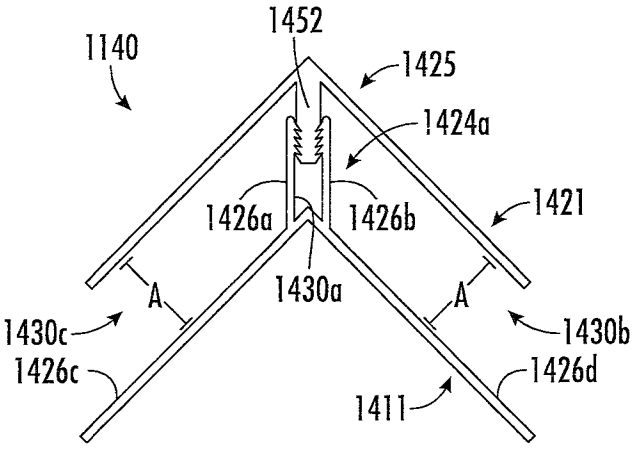
FIG 14

PANEL ASSEMBLY

The present application is a continuation-in-part of U.S. patent application Ser. No. 17/029,774 filed on 23 Sep. 2020, titled "Panel Assembly," which is incorporated herein for all purposes.

BACKGROUND

1. Field of the Invention

The present application relates to panel assemblies. In particular, the present application relates to aluminum interlocking panel assemblies.

2. Description of Related Art

Panel assemblies are aesthetic assemblies that can provide structural support, protection from the environment, delineate walkways, and in some cases, provide acoustic variation. Panel assemblies are typically affixed to the sides of buildings, installed near doors, connected together with canopies, and form free-standing structures. When affixed to the sides of a building, panel assemblies are useful to decorate the building. However, conventional panel assemblies often are monochromatic, or do not easily give the appearance of real wood.

Conventional panel assemblies are assembled and connected together, often with adhesive, on-site, making them immobile without significant damage to the building to which they are attached or to the individual panel beams of the assembly. After connecting the panel assembly together, the assembly is sanded and then painted or finished on-site, often requiring caustic chemicals to be used on-site.

Conventional panel assemblies often have exposed cuts from the various dimensions of the individual parts. Often, the irregular sized/shaped parts that result from cutting cannot be used, resulting significant waste. Gaps between cuts are often created by butting joints of the individual parts together. Over time, these gaps expand, creating aesthetic and structural deficiencies in the panel assembly. General wear and tear, for example from hail, rain, foot traffic, etc., can cause individual panels to become disconnected, making them loose relative to the remainder of the panels. Repairing loose paneling is difficult, time-consuming, and expensive.

Often, panel assemblies are made of wood or other materials susceptible to mold, mildew, bacteria, odors, or other contaminants. Once contaminated, the panel assembly must be sanded, refinished, and/or removed, in order to nullify the effects of the contamination.

Thus, conventional panel assemblies are limited by their ability to provide desired aesthetic appeal, be securely fabricated, be finished at a manufacturing facility, be moved in one-piece to the jobsite, and/or provide contaminant-resistive properties. Additionally, large panel assemblies are heavy, making them difficult to hoist and install due to their weight and size. Furthermore, the connected panel assemblies cannot be resized at the jobsite once the assembly is connected together, greatly limiting on-site adjustments. Thus, there exists significant room for improvement in the art for overcoming these and other shortcomings of conventional systems and methods for panel assemblies.

Although the aforementioned methods of constructing panel assemblies represent great strides in the area of paneling, many shortcomings remain.

BRIEF DESCRIPTION OF THE DRAWINGS

The novel features believed characteristic of the present application are set forth in the appended claims. However, the invention itself, as well as a preferred mode of use, and further objectives and advantages thereof, will best be understood by reference to the following detailed description when read in conjunction with the accompanying drawings, wherein:

FIG. 12 is a top plan view of an embodiment of a border support, according to the present application;

FIG. 13 is a top plan view of an alternative embodiment of a border support, according to the present application;

FIG. 14 is a top plan view of an alternative embodiment of a border support, according to the present application;

FIG. 15 is a top plan view of an alternative embodiment of a border support, according to the present application;

FIG. 16 is a top plan view of an alternative embodiment of a border support, according to the present application;

DETAILED DESCRIPTION

Figure 1:
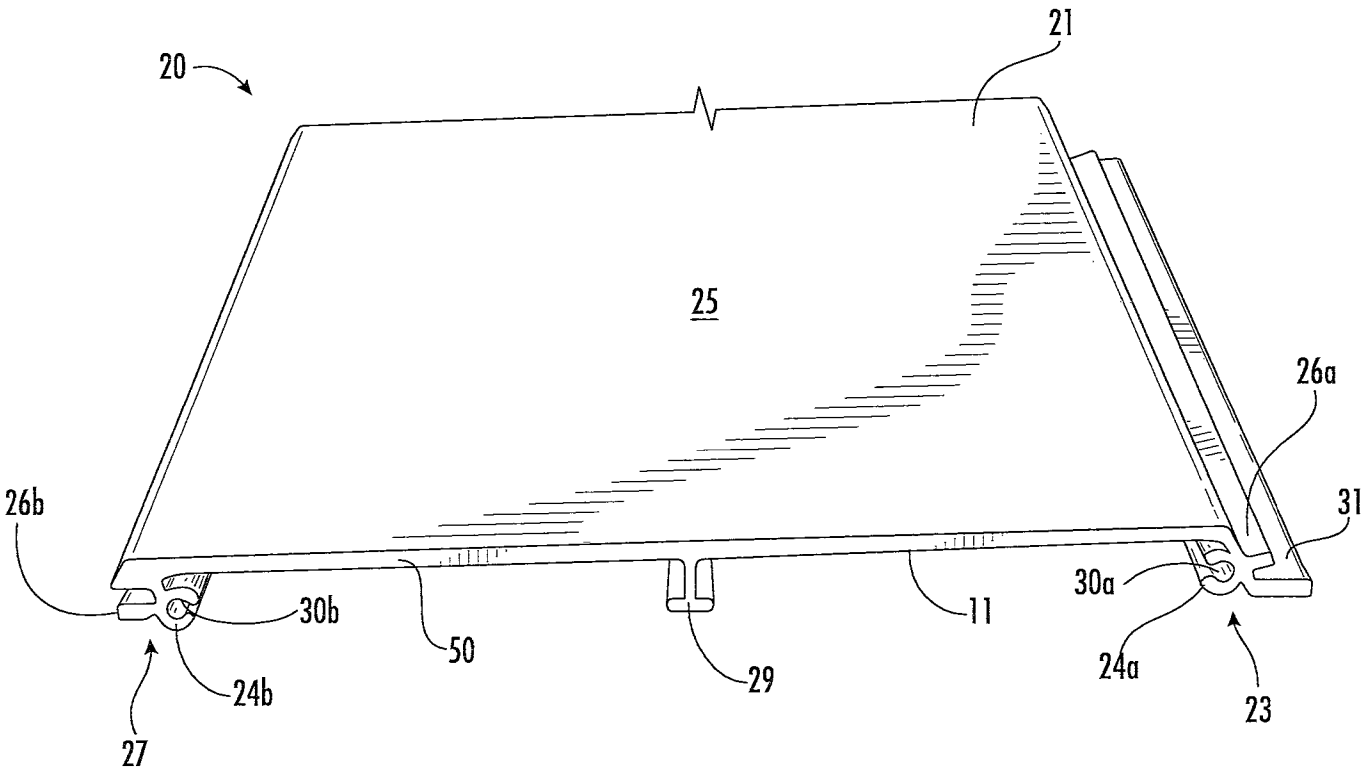
FIG. 1 is a perspective view of an end of a panel beam, according to the present application.

Referring to FIG. 1 in the drawings, an interconnecting panel support 20 is illustrated. Panel support 20 is a beam having a hidden portion 11 and a visible portion 21. Hidden portion 11 is hidden from human visible perception while panel support 20 is a component of a panel assembly by interconnecting an end of panel support 20 with another end of another panel support. For example, a receiving end 23 of panel support 20 has an attachment member 26*a* connected to a body portion 25 of panel support 20, and an inserting end 27 of panel support 20 has an overlapping inserting member 26*b* connected to body portion 25 of panel support 20. Body portion 25 spans a length of panel support 20.

Preferably, attachment member 26*a* and inserting member 26*b* are flanges, but could also be formed as tabs, tongues, or posts. Either a groove of receiving end 23 receives the inserting member of another panel support, or inserting end 27 inserts into the receiving end of another panel support (see FIG. 11) to form a panel assembly. Preferably, both attachment member 26*a* and inserting member 26*b* are included in the hidden portion 11, such that upon assembly, neither member 26 is visible to an observer viewing the exterior surface of the panel assembly.

Preferably, inserting member 26*b* is removably encompassed about by a portion of another panel of the panel assembly. Alternatively, the portion of the other panel is in-part removably encompassed about by inserting member 26*b*.

In a preferred embodiment, the shape and configuration of receiving end 23 comprises and inverted F-shape, having an inverted C-shape integrally attached to the inverted F-shape. The shape and configuration of inserting end 27 comprises an inverted C-shape, a J-shape, or sideways U-shape, having another C-shape integrally attached to it.

In a preferred embodiment, attachment member 26*a* is about 10-14% of the entire width of a panel support 20 without a centered support, and about 6-8% of the entire width of a panel support 20 that has a centered support. Inserting member 26*b* is about 3-7% of the entire width a panel support 20 without a centered support, and about 2-3% of the entire width of the panel beam with a centered support. A recess between the two flanges of receiving end 23 is approximately twice as wide/thick as the wall thickness of panel support 20. A groove or recess in inserting end 27 is approximately 30-40% wider/thicker than the wall thickness of panel support 20.

Preferably, panel support 20 has curved support members 24*a*, 24*b* that have openings 30*a*, 30*b*. Curved support members 24*a*, 24*b* function or are formed as screw bosses, clip members, structural reinforcing supports, and/or provide additional advantages as described below. Preferably, openings 30*a*, 30*b* have approximately identical dimensions. In at least one embodiment, openings in curved member 24*b* of inserting end 27 is about 6% larger than opening 30*a* in receiving end 23. Other dimensions and dimensional variations are encompassed by the Present Application.

In a preferred embodiment, the sidewalls connected to body portion 25 are slightly angled at a similar or identical angle to form a groove for assembly with another panel beam. For example, one sidewall may have an angle of from about 15-30 degrees relative to a vertical plane extending through the C-shape of curved support member 24*a* (see, receiving end 123 of FIG. 2A). The other sidewall has at least a portion of the sidewall formed at a similar, if not identical, angle. Despite the angle of about 15-30 degrees, the sidewalls extend substantially vertically beneath the surface of the body, such that screw bosses 24*a*, 24*b* are positioned at a normal to the visible portion 21 of body 25. It is important to note that screw bosses 24*a*, 24*b* may span an entire length of a panel support. Alternatively, screw bosses 24*a*, 24*b* are separated into multiple, discrete segments positioned at intervals along the length of the panel support.

In a preferred embodiment, at least one of ends 24, 27 of panel support 20 includes another linear flange or attachment tab parallel to and paired with the first linear flange. For example, receiving end 23 has an attachment tab 31 parallel to and paired with first linear flange 26*a*. It is noted that receiving end 23 of panel support 20 is configured to receive a linear flange of an inserting end 27 of a second panel beam (not shown in FIG. 1). It is further noted that although the attachment tabs/flanges are depicted as linear, alternatively the attachment tabs/flanges are angled, beveled, chamfered, ridged, curved, or combinations thereof.

In at least one embodiment, panel support 20 includes an optional centered support 29 that is approximately centered along body 25 of panel support 20. Although centered support 29 is depicted as a component formed in the unitary structure of body 25, alternatively, centered support 29 may be formed by folding, attachment, such as welding, or by other means known in the art. Centered support 29 is optional depending on multiple factors, including but not limited to, one or more dimensions of panel support 20, an intended use for panel support 20, and a desired aesthetic preference. For example, panel support 20 may vary in width, with some embodiments being from three to four inches in width, while other embodiments may be from six to eight inches in width. Centered support 29 may be included in the larger dimensioned embodiments, but optionally excluded from the smaller dimensioned embodiments. It is noted that additional dimensional variations not specifically mentioned are encompassed by the Present Application.

Preferably, panel support 20 is an extruded aluminum beam, formed using a die print that has a shape therein that is the same shape as face 50 of the panel support 20. For example, a die is first formed, then a heated aluminum billet is pushed through the die having the shape of face 50 to form panel support 20. Other steps in beam formation may include but is not limited to, quenching, mechanical treatment, and aging.

Figures 2A, 2B, 2C:
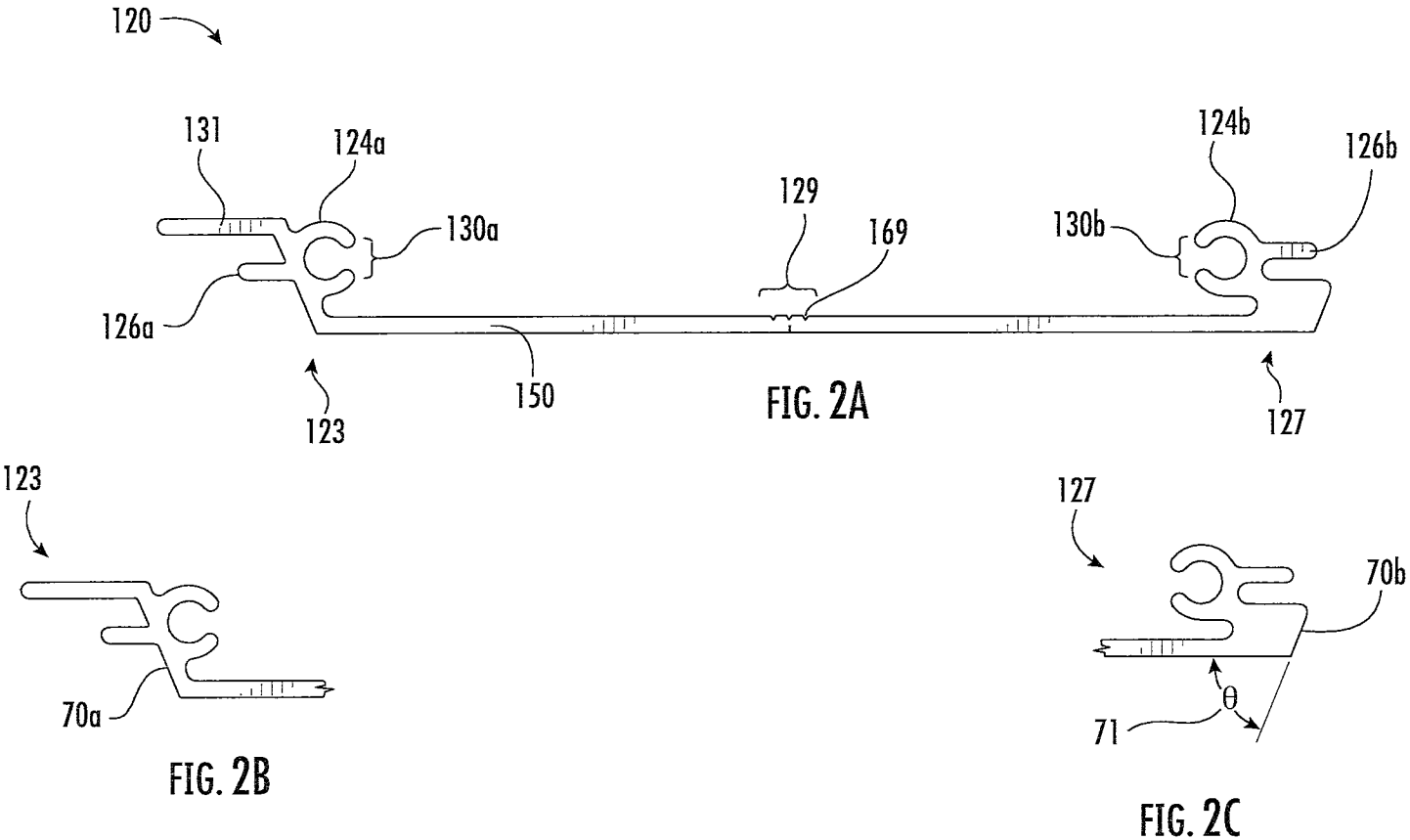
FIG. 2A is a top plan view of a face of an alternative panel beam, according to the present application.
FIGS. 2B-2C are partial top plan views of the face of the panel beam of FIG. 2A.

Referring now to FIGS. 2A-2C in the drawings, an alternative face 150 of an alternative embodiment of a panel support 120 is illustrated. The alternative beam face 150 is similar to beam face 50, except that the inverted F-shape of a receiving end 123 (FIG. 2B) is connected to a screw boss 124*a*, having a C-shape, and to screw boss 124*b*, having an inverted C-shape (FIG. 2C), of an inserting end 127 by a center portion 129.

Center portion 129 includes one or more grooves 169. Alternatively, centered portion 129 includes folds, bends, creases, or other structural enhancements to modify the strength of the beam. In at least one embodiment, the top and bottom surfaces of center portion 129 of support 120 are smooth. It is important to note that ends 123 and 127 depicted in FIG. 2B and FIG. 2C, respectively, have line breaks, indicating that panel support 120 can be of almost any dimension.

Referring now to FIG. 2B in the drawings, receiving end 123 has an angled sidewall 70*a*. Angled sidewall 70*a* has an angle that is similar, if not identical, to an angle, theta 71, of the angled sidewall of insertion end 127. For example, referring now to FIG. 2C in the drawings, angled sidewall 70*b* of insertion end 127 has an angle, theta 71 of about 60-75 degrees relative to a horizontal plane extending along the top surface of the face 60, while the angle of angled sidewall 70*a* is also about 60-75 degrees. It is noted that the angle and/or shape of sidewalls 70 may vary depending on an aesthetic appeal or on a desired shape of a groove that will be formed when a first panel beam is placed adjacent a subsequent panel beam. Despite the angle of sidewalls 70, screw bosses 124*a*, 124*b* are located at a normal to the visible top surface of the body portion.

Figure 3:
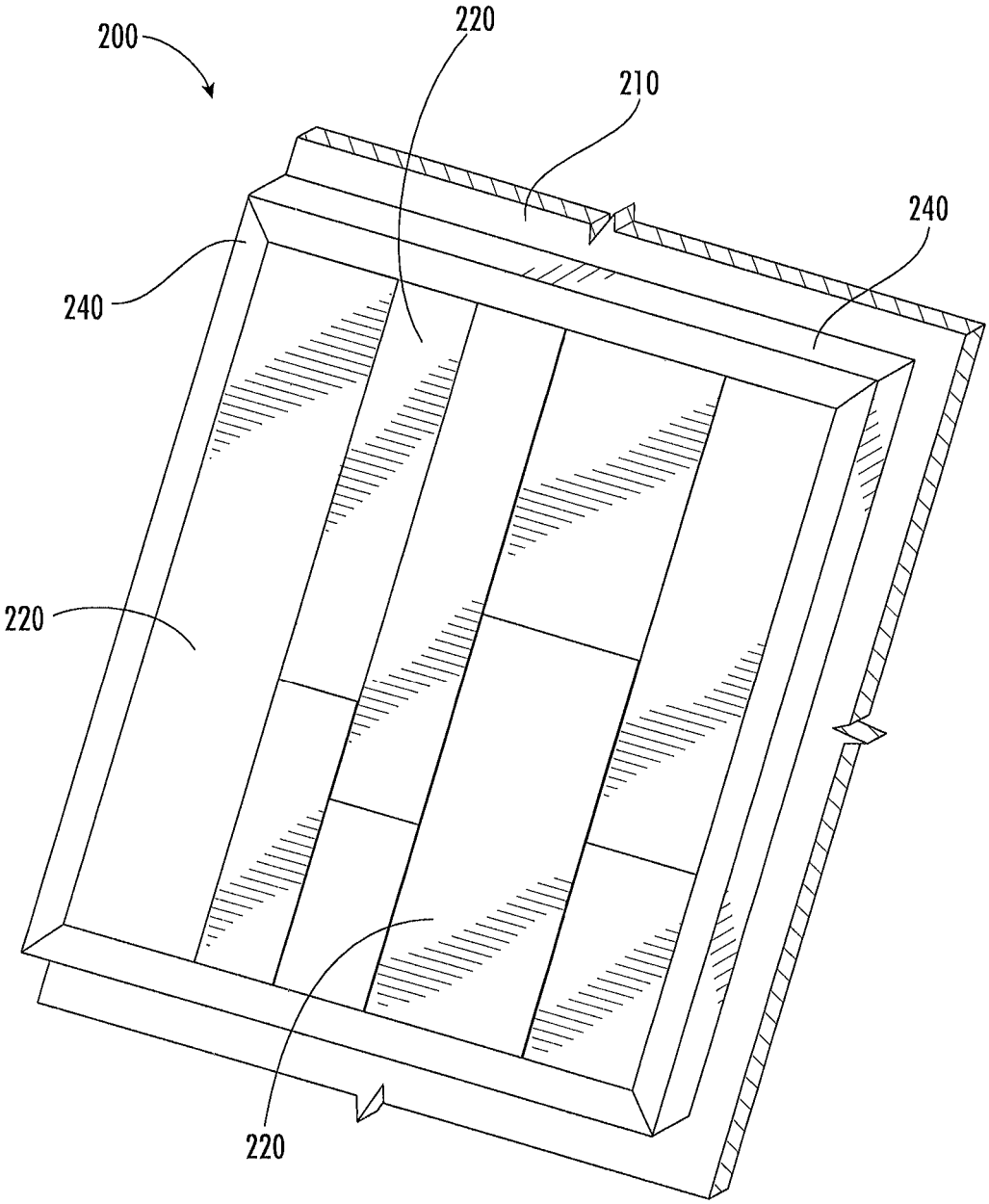
FIG. 3 is a perspective view of a panel assembly, according to the present application.

Referring now to FIG. 3 in the drawings, a panel assembly 200 is illustrated. Panel assembly 200 includes a panel support substrate 210 and multiple rectilinear panels 220 interconnected together and attached to panel support substrate 210. In at least one embodiment, panel assembly 200 also includes one or more border supports 240 attached around a perimeter of multiple rectilinear panels 220. In a preferred embodiment, panel beams of panel assembly 200 have a vertical or substantially vertical orientation. Alternatively, panel beams can be arranged horizontally, diagonally, with criss cross patterns, or combinations thereof.

Panel assembly 200 can be cut to length in a shop or in at the installation site because the extruded members are shipped unassembled from the shop to the installation site. Furthermore, because the extruded members can be cut at the site before assembly the parts for the panel assembly can be adjusted at the site. For example, if the measured length of the panel assembly needed to be reduced, the panel beams can be precisely cut to reduce the length of the panel assembly. Conventional welded panel assemblies require a large amount of work to adjust the dimensions of the panel assembly. Since the panel assembly is assembled at the installation site, the amount of equipment to hoist the panel assembly up bit by bit is less than the amount of hoisting equipment needed for conventional welded panel assemblies.

It should be apparent that panel assembly 200 does not have fasteners viewable from a front elevation view of the panel assembly. The hidden fasteners of panel assembly 200 increase the aesthetic appeal of the assembly. Furthermore, the hidden fasteners require less finishing work and over time any corrosion due to a reaction between the fasteners and the extruded members is hidden from view.

Figure 4:
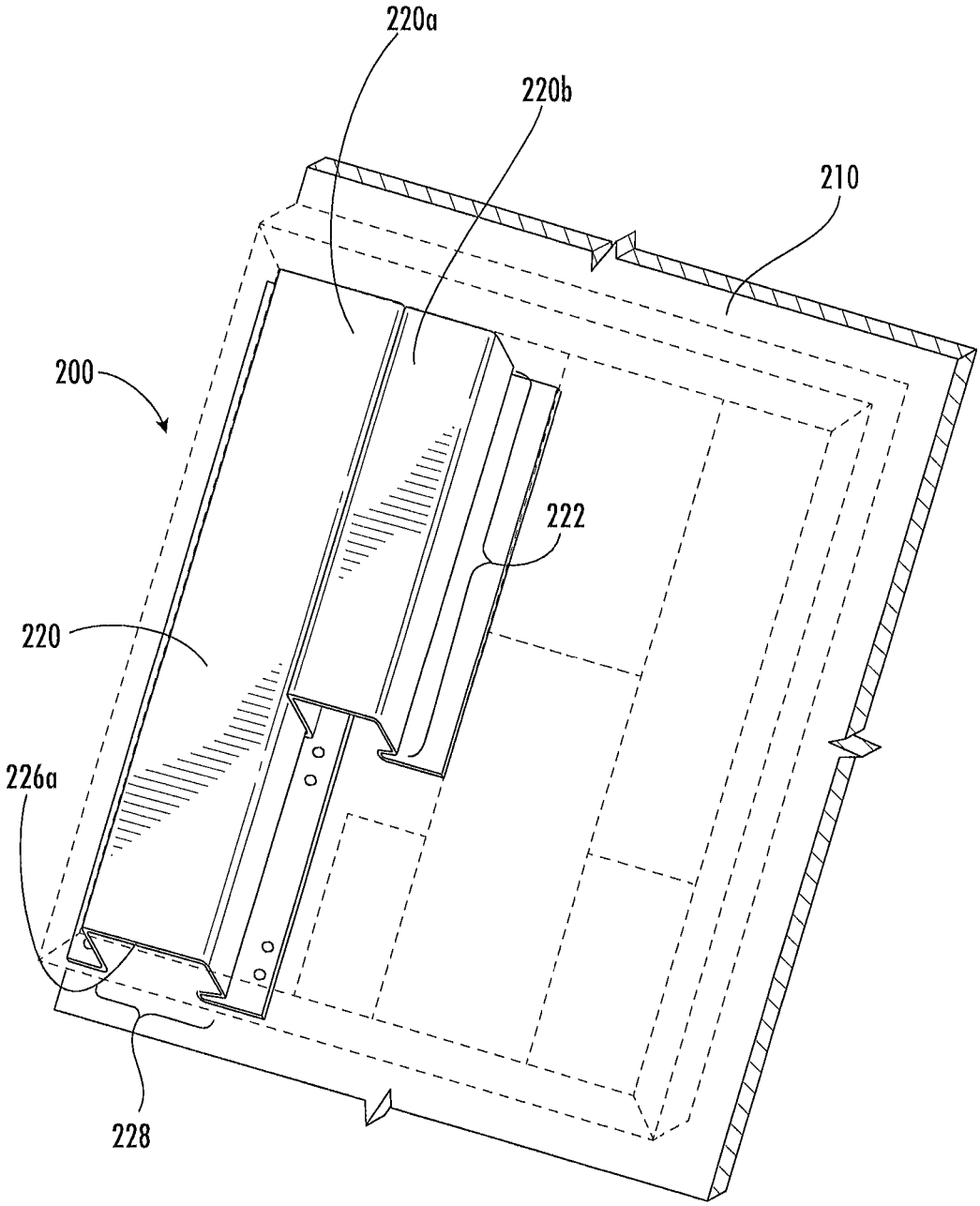
FIG. 4 is a perspective view of a partial panel assembly of FIG. 3.

Referring now also to FIG. 4 in the drawings, panel assembly 200 is formed using alternative embodiments of panel support 20. For example, panel assembly 200 includes a first panel beam 220*a* interconnected with a second panel beam 220*b*. The interconnection of first panel beam 220*a* and second panel beam 220*b* includes a layering or overlapping of a portion of second panel beam 220*b* onto first panel beam 220*a* along a longitudinal dimension 222. Preferably, longitudinal dimension 222 is greater than a latitudinal dimension 228. Alternatively, depending at least on aesthetic preference, latitudinal dimension 228 may be greater than longitudinal dimension 222. Panel beam 220*a* preferably includes a downturned edge 226*a*.

Figure 5:
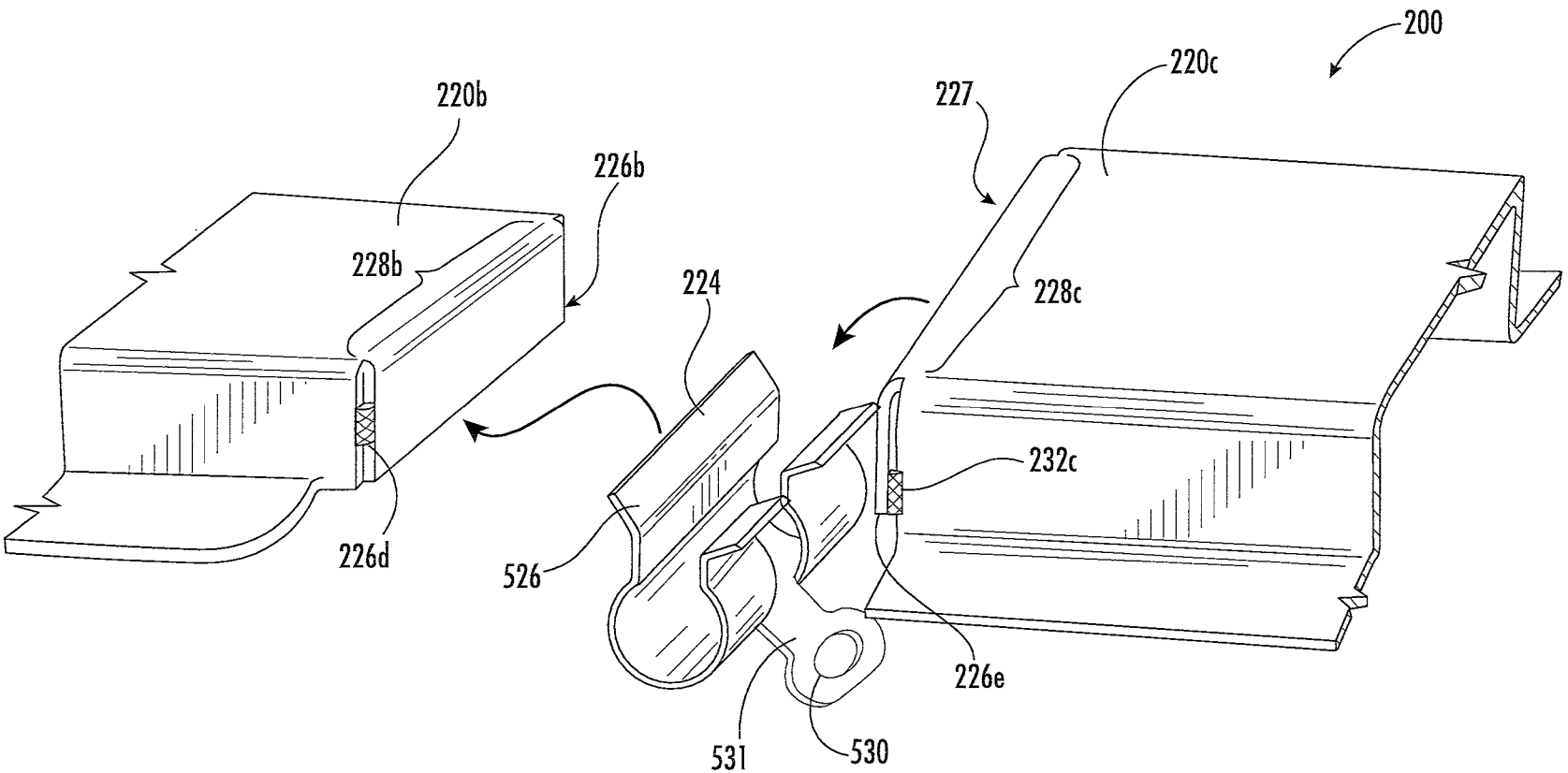
FIG. 5 is an exploded view of a clip member, according to the present application.

Referring now also to FIG. 5 in the drawings, panel assembly 200 includes second panel beam 220*b* abutting a third panel beam 220*c* and multiple hidden fasteners 226. The abutment of second panel beam 220*b* to third panel beam 220*c* is secured using a clip member 224, such as a steel or aluminum caddy clip. Clip member 224 secures edge 226*c* of panel beam 220*c*, having a latitudinal dimension 228*c*, to edge 226*b* of panel beam 220*b*, having latitudinal dimension 228*b*, which corresponds in size and alignment to latitudinal dimension 228*c*. It is important to note that edge 226*a* having latitudinal dimension 228*a* of first panel 220*a* (FIG. 3) can be of the same dimension or a different dimension than latitudinal dimensions 228*b* and 228*c*. The difference may depend upon a desired lateral dimension, a strength required by governmental regulation or code, a desired aesthetic appeal, and/or a combination thereof.

Clip member 224 preferably includes one or more flanges 526 and a spring bias created by the material of clip member 224, the spaced-apart structure, a proximity of one or more walls and flanges 526, and/or combinations thereof. Clip member 224 also includes an opening 530 within a tab 531 for receiving the stud of a fastener. Tab 531 extends away from the body of clip member 224. Clip member 224 facilitates the alignment and fastening of panel beams 220*b* and 220*c* to each other and to substrate 210. Opening 530 may be configured as circular, elongated, elliptical, rectangular, slots, holes, or combinations thereof. Openings 530 are strategically placed to hide fasteners used to secure the panel assembly 200 from visual sight relative to the exterior of the panel assembly 200.

Panel 220 of the multiple rectilinear panels is preferably made of aluminum, an aluminum alloy, or an anodized aluminum, where, during the anodizing, the aluminum is treated with a dye or a color pigment to provide color to the aluminum. For example, a dye may give the aluminum a wood-like appearance. Alternatively, panel 220 is made of a sheet metal material, such as steel, tin, or combinations of metals and/or metal alloys and incorporates an external coloration and/or pigmentation. It is noted that the lightweight materials are preferred, as they can be thin enough and still provide sufficient strength to be as durable as wood, and yet add less weight to the assembly than a wooden beam. For example, beams having wall thicknesses as low as from about 0.05 inches to 0.07 inches are used in the panel assembly 200. Beams having larger wall thicknesses are also encompassed by the present application.

Because folded/bent panel beams can be formed and cut at the job-sit, or in the shop, according to any desired dimension, there is a significant reduction in waste from forming panel assemblies from the panel beams. For example, a panel beam can be formed to the precise length needed, and together with the clip members and attachment ends of the panel beams, there is no need to cut the beams into wasteful segments.

In at least one embodiment, panel beam 220 is formed from sheet metal as a single unitary component, including spaced-apart hems. Likewise, clip members 224 are also formed as a single unitary component.

Panel beams 220*b* and 220*c* are depicted having ends 226*b* and 226*c* welded with welds 226*d* and 226*e*, providing additional support to the respective panel beams. Alternatively, the flanges corresponding to the edges 226*b* and 226*c* are unattached, meaning the edges 226*b* and 226*c* are folded downward or bent at the appropriate angle and do not include a weld or other attachment means, relying on the force of the bend to maintain the desired shape of the panel beams 220*b* and 220*c*.

Figure 6:
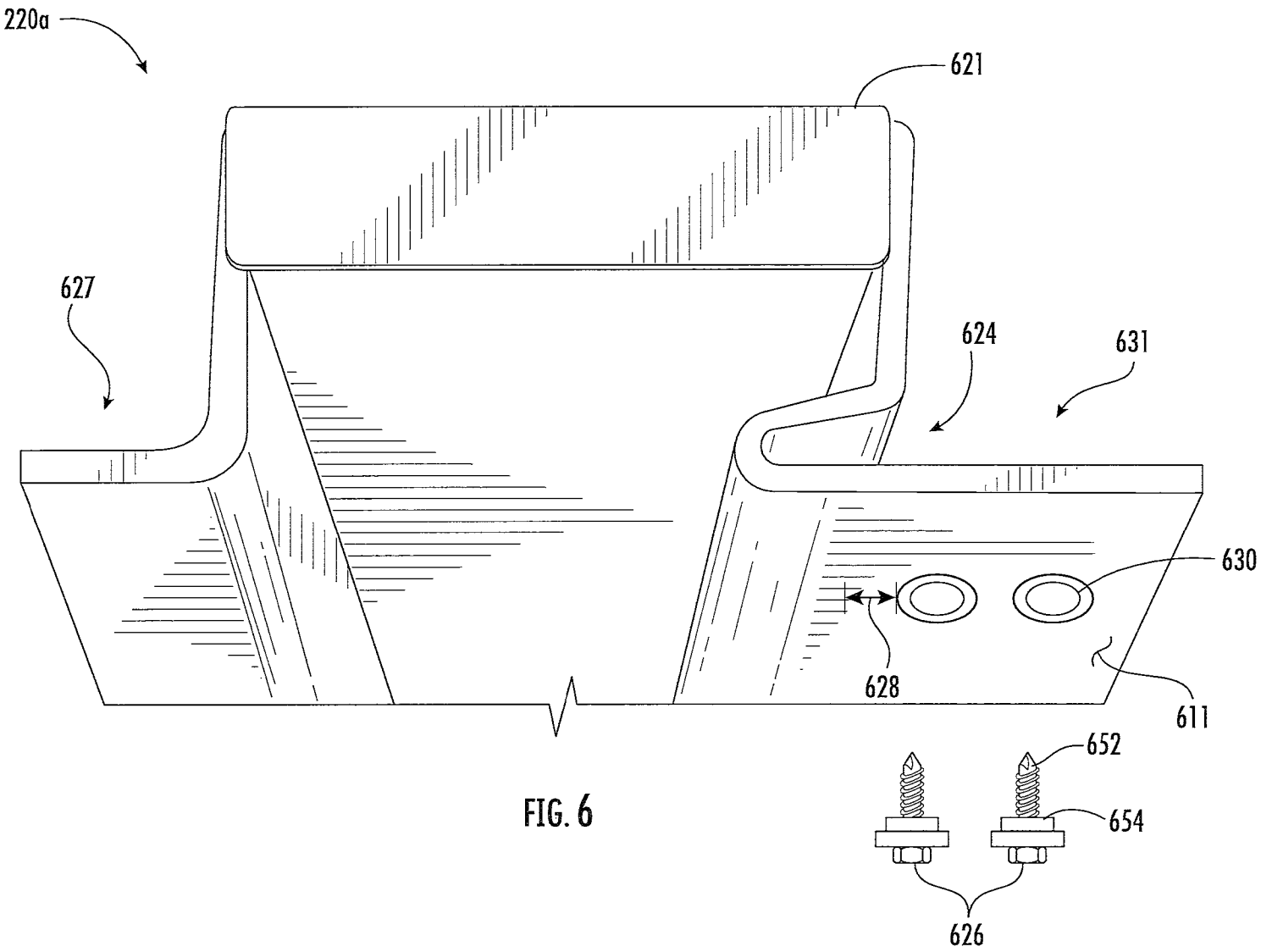
FIG. 6 is a perspective view of an end of an alternative panel beam, according to the present application.

Referring now also to FIG. 6 in the drawings, an exploded view of an end portion of panel beam 220*a* from the multiple rectilinear panels 220 is illustrated. Panel beam 220*a* has a bottom surface 611, a top surface 621, a spaced-apart hem 624, and one or more hidden fasteners 626. Spaced-apart hem 624 functions similar to clip member 24 in that spaced-apart hem 624 is configured to receive an edge or a flange of an adjacent panel beam. For example, spaced-apart hem 624 has a gap with a width at least as wide as the width of an attachment flange of an adjacent panel beam that is similar, if not identical, in size and shape to an insertion tab 627 of panel beam 220*a*. An attachment flange 631 and insertion tab 627 may extend along the full length of panel beam 220*a*, or may only extend partially along the length of panel beam 220*a*. Bottom surface 611 of attachment tab 631 is farther from top surface 621 of panel support 220*a* than bottom surface 611 of insertion tab 627.

Attachment flange 631 includes one or more openings 630 for attachment to panel support substrate 210. Although the shape of openings 630 are depicted as circular, other openings having different shapes, sizes, and dimensions are encompassed in the present application. For example, openings 630 may be circular to receive threaded stud 652 of a fastener, or elongated to receive the head of a fastener that is inserted then turned to lock the fastener in place. Openings 630 may be configured as slots to receive a hook or a tab mounted to, or extending from, panel support substrate 210, or to allow for adjustment. At least one opening 630 has an adjacent dimension 628 relative to a longitudinal surface of panel beam 220*a* and/or relative to the width of attachment tab 627. For example, adjacent dimension 628 may be equivalent to the width of insertion tab 627, such that the insertion tab of another panel beam (not shown) does not rest on a fastener inserted into opening 630.

Spaced-apart hem 624 is made when attachment tab 631 is folded or bent towards top surface 621 of panel beam 220*a*. After the folding or bending, bottom surface 611 rests parallel to a surface of the panel support substrate 210. Within spaced-apart hem 624, top surface 621 of panel beam 220*a* is situated at an angle offset from the surface of panel support substrate 210.

Multiple fasteners 626 of the panel assembly 200 are configured to have self-securing, self-sealing, and/or water-resistive properties. For example, fasteners 626 may include a self-tapping screw head 652 and a water-sealing O-ring or gasket 654, such as a nylon or neoprene washer. Fasteners 626 drill into one or more layers of sheet metal to attach a panel beam to a surface of panel support substrate 210. It is important to note that the use of water-sealing fasteners, the non-corrosive material composition, and the overlapping or layering configuration of attachment tab 631 with a second attachment flange of another panel beam provides water-resistant properties to panel assembly 200. It is also important to note that although fasteners 626 are depicted as below bottom surface 611, fasteners 626 are preferably inserted from above top surface 621 of attachment tab 631.

Figure 7:
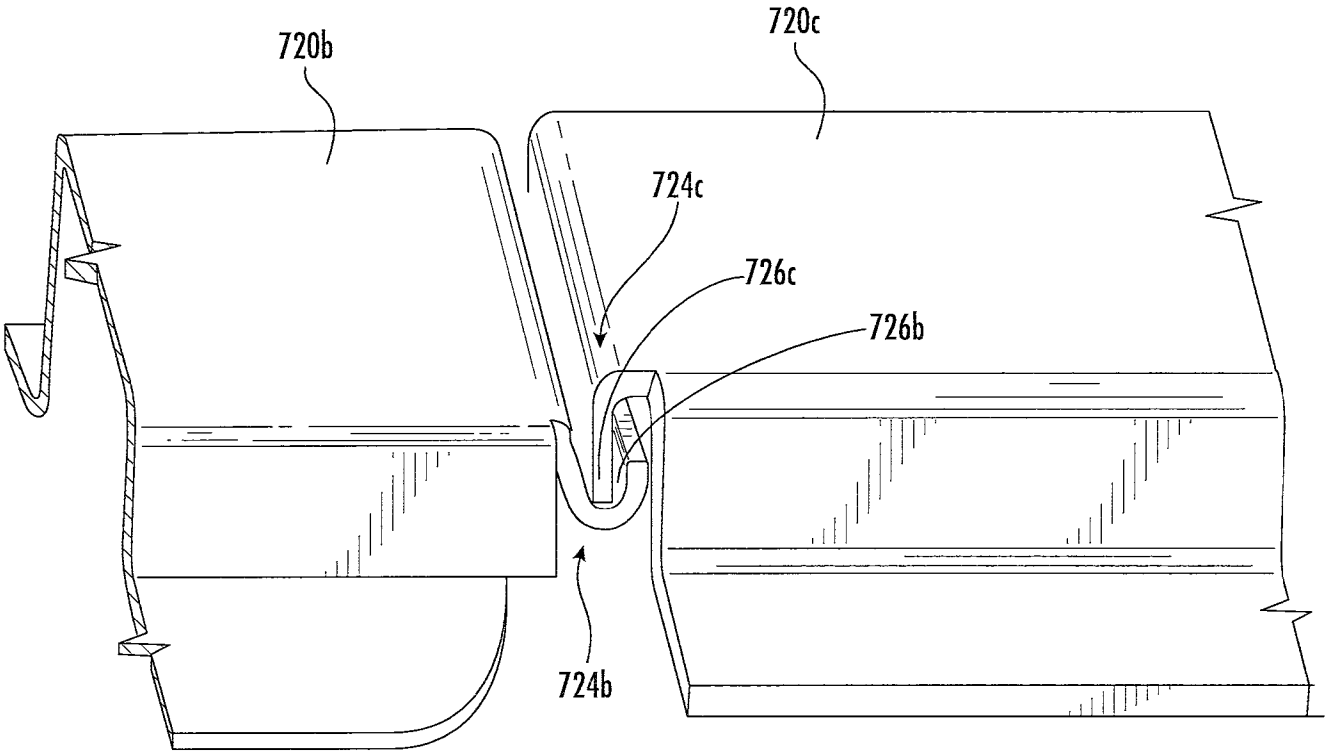
FIG. 7 is a perspective view of alternative ends of panel beams, according to the present application.

Referring now also to FIG. 7 in the drawings, alternative panel beams 720*b* and 720*c* for panel assembly 200 are illustrated. At least one of the alternative panel beams, such as panel beam 720*b*, includes spaced-apart hems 724*b*, 724*c*. Spaced-apart hem 724*a* is made from folding or bending an edge 726*b* with a gap that has a shape and size that will receive an edge 726*c*. It is important to note that although edge 726*a* is not depicted, it can be formed similar to edge 726*b* or edge 726*c*, depending upon how border supports 240 are formed.

Figure 8A:
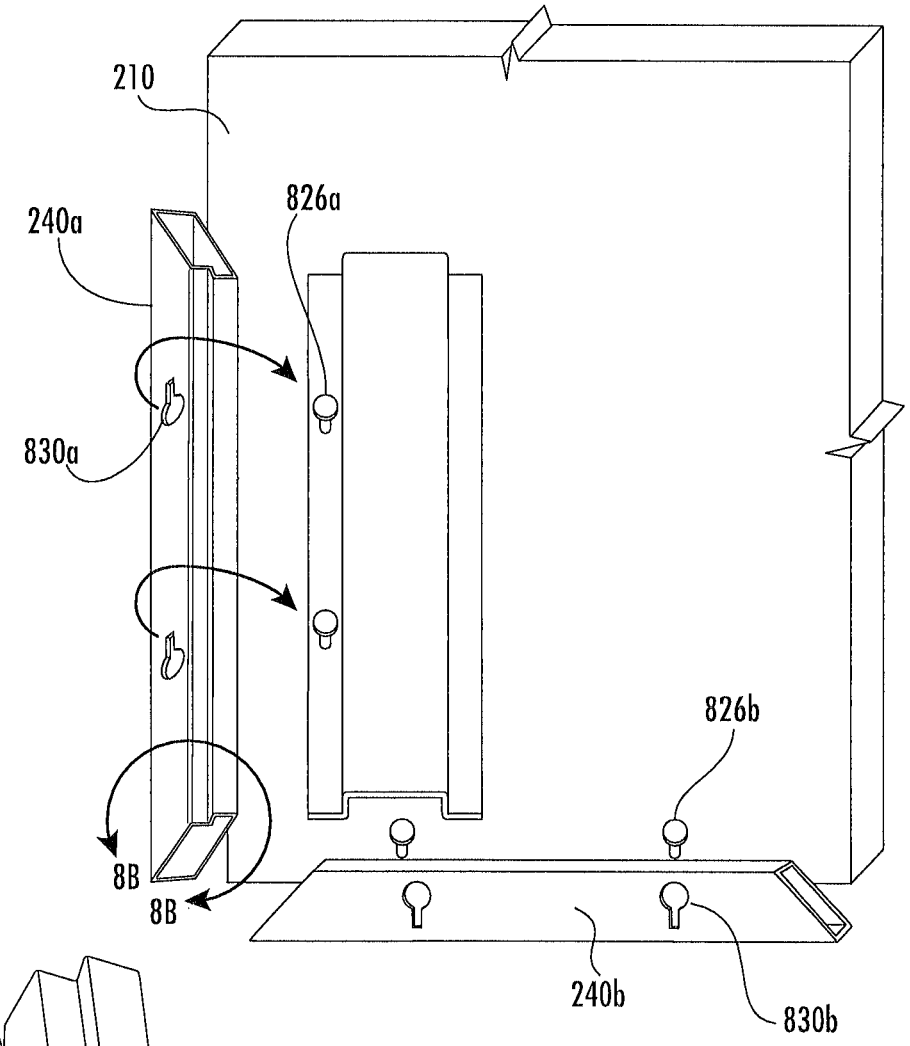
FIG. 8A is a partial assembly view of border support beams, according to the present application.
Figure 8B:
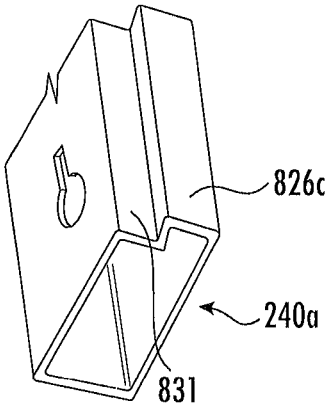
FIG. 8B is an exploded view of an end of a border support beam of FIG. 8A.

Referring now to FIGS. 8A and 8B in the drawings, two border support beams 240*a* and 240*b* are illustrated upside down, or having their bottom surfaces directed out. Border support beams 240*a*, 240*b* include multiple locking openings 830*a*, 830*b*. Locking openings 830*a*, 830*b* are shaped to correspond to a shape of the heads of fasteners 826*a*, 826*b*. Locking openings 830*a*, 830*b* include at least two different dimensions, where the first dimension is shaped and sized similar to the head of the fasteners and is greater than the second dimension. The second dimension is shaped and sized similar to a stud of fasteners 826*a*, 826*b*. The difference in dimensions allows border support beam 240*a* or 240*b* to be flipped over, such that the openings are collinearly aligned with fastener heads 826*a*, 826*b*. Upon insertion of fastener heads 826*a*, 826*b* into locking openings 830*a*, 830*b*, support beams 240*a*, 240*b* are slid into place, such that the studs of fasteners 826*a*, 826*b* are in the narrow dimension of locking openings 830*a*, 830*b*. Although border support beams 240 are depicted as multiple border supports, in at least one embodiment border support beam 240 is a single, unitary structure comprising a framing support.

In an alternative embodiment, border support beams 240, or a portion thereof, are replaced by, or used in-part together with, end caps that insert into portions of the extruded panel support 220. For example, the end caps may include pegs, dowels, or studs that insert vertically into clip members 24 having openings 30 similar to those depicted in FIG. 1, while other end caps may have tabs that insert or are received by receiving end 23 and/or inserting end 27. By way of another example, end caps with vertical pegs, dowels, or studs may be used on the top (e.g., face 50) and bottom latitudinal surfaces of panel beam(s) 20, while border support beams 240 may be used on the sides or longitudinal surfaces of the panel beam(s) 20. In each embodiment, the fasteners used to secure panel assembly 200 are hidden from view.

It is important to note that although support beams 240*a*, 240*b* are depicted as tube-like beams having 45° angles, this depiction is only for simplification in explaining one attachment mechanism of support beams 240*a*, 240*b*. Other embodiments of support beams 240 include individual beams having edges and/or spaced-apart hems to interconnect with edges and spaced apart hems at the latitudinal edges of panel beams 220.

As shown in FIG. 8B, an exploded view of an end of border support beam 240*a* is illustrated. The end is depicted as having an edge that will secure to the latitudinal edges of panel beams 220. Although the edge is formed from a flange 826*c* and attachment tab 831 that are offset from each other to form an opening to receive a latitudinal edge of panel beam 220, this depiction again is only a simplified depiction. Other embodiments of support beams 240 have different longitudinal edges, such as a spaced-apart hem (not shown)

to interconnect with another edge of panel beam 220. It is noted that other folds and bends will be envisioned by those skilled in the art to integrate with the edges and ends of panel beams 220 in panel assembly 200. Each of these variations are envisioned and encompassed in the present application.

It is further noted that although locking openings 830*a*, 830*b* are depicted as formed in an underside of the support beam 240*a* and 240*b*, the locking openings may be formed in other locations. For example, the locking opening depicted in FIG. 8B may be formed along the length of material connecting flange 826*c* and attachment tab 831. In at least one embodiment, support beam 240*b* is shaped similar to beam 240*a*, having the material connecting flange 826*c* and attachment tab 831 removed, such that flange 826*c* and attachment tab 831 are disconnected relative to each other. Flange 826*c* is then configured to mate with one or more upturned edges formed on the lower latitudinal edge(s) of one or more beams attached to substrate 210.

Figure 9B:
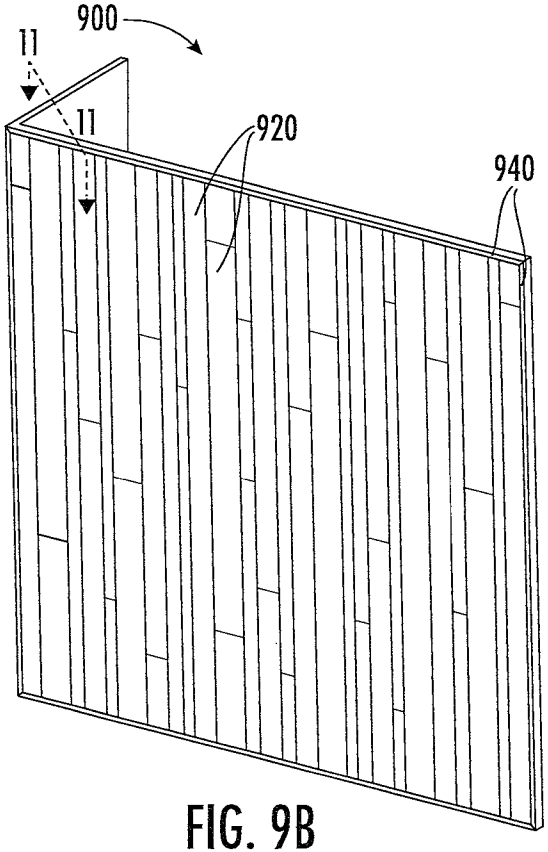
FIG. 9B is a perspective view of the panel assembly of FIG. 9A.
Figure 9A:
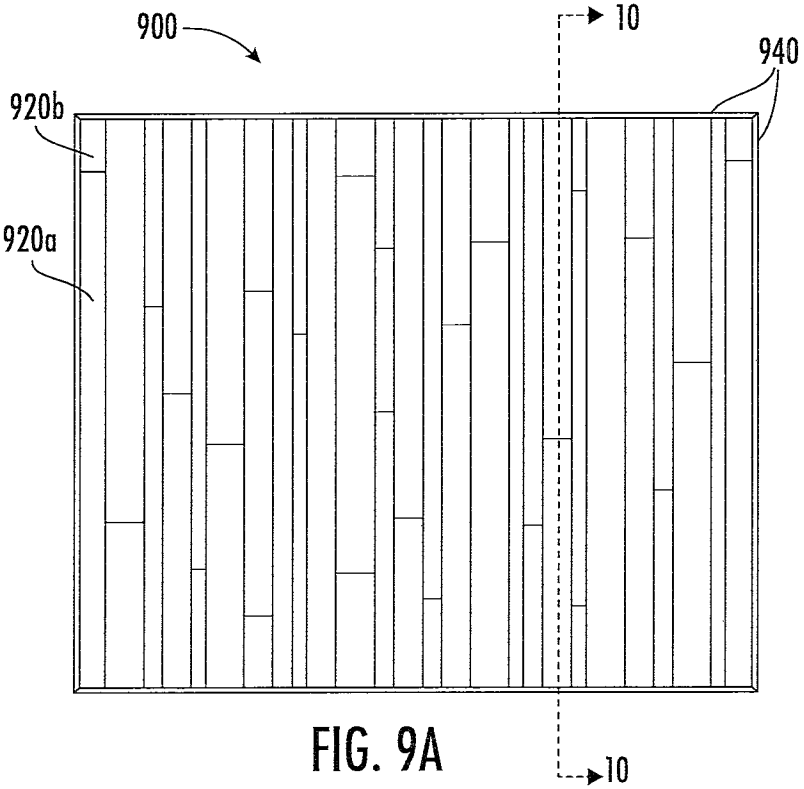
FIG. 9A is a front elevation view of a preferred embodiment of a panel assembly, according to the present application.

Referring now to FIGS. 9A-9B in the drawings, a panel assembly 900 comprising a vertical extruded plank system is illustrated. Panel assembly 900 is configured to connect directly to a wall (see wall 1010 in FIG. 10) and includes multiple rectilinear panels 920 interconnected together and configured to be attached to the wall. In a preferred embodiment, panel assembly 900 also includes one or more border supports 940 attached around a perimeter of multiple rectilinear panels 920. Preferably, panel beams 920 of the panel assembly 900 have a vertical or substantially vertical orientation. Alternatively, panel beams can be arranged horizontally, diagonally, with criss cross patterns, or combinations thereof.

Figure 10:
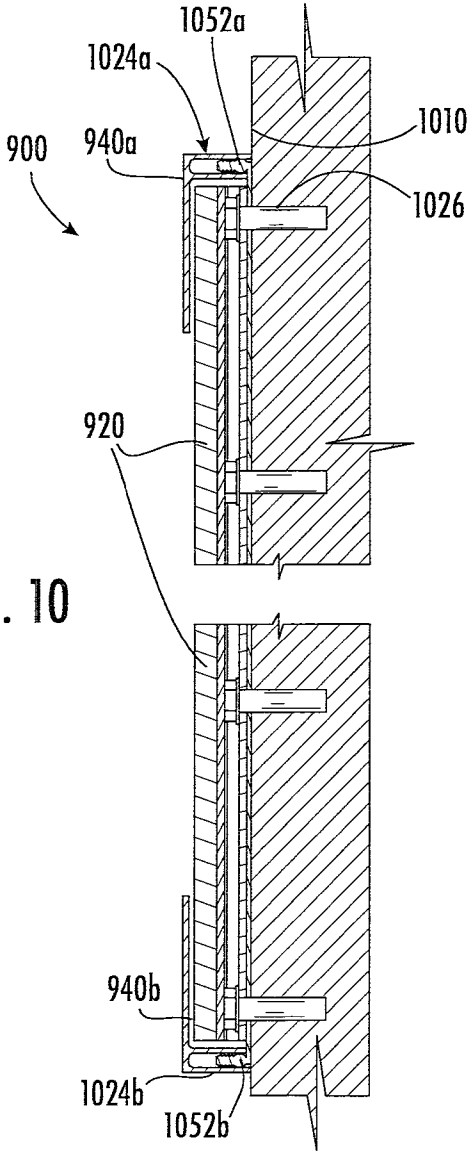
FIG. 10 is a top, partial section view taken along Section Line 10-10 of the preferred embodiment of a panel assembly, according to the present application.

Referring now to FIG. 10 in the drawings, a top, downward view of a panel assembly 1000 attached directly to wall 1010 is depicted, illustrating side border supports 1040*a*, 1040*b*. Panel assembly 1000 includes multiple vertically-oriented panel beams 1020 interconnected together and attached directly to wall 1010 using multiple fasteners 1026. Side border supports 1040*a* and 1040*b* create a partial seal about longitudinal ends of the panel beams 1020. Preferably, the border supports 1040*a* and 1040*b* are J-trim, two-part elements. A first part of a first two-part element 1040*a* has an F-shape, including a clip member 1024*a*, and the second part of the two-part element has a stud 1052*a*. The second two-part element 1040*b* is identical, but oppositely oriented, having clip member 1024*b* and stud 1052*b*. Preferably, each of clip members 1024 include ridges, grooves, catches or other formations that fit together with corresponding formations in studs 1052, enabling a secure connection between the two-parts of the two-part elements 1040, and thereby forming the J-shape of the trim. Alternatively, the border supports may be configured as a single J-shape trim (see, border support 1340 in FIG. 13, below).

Figure 11:
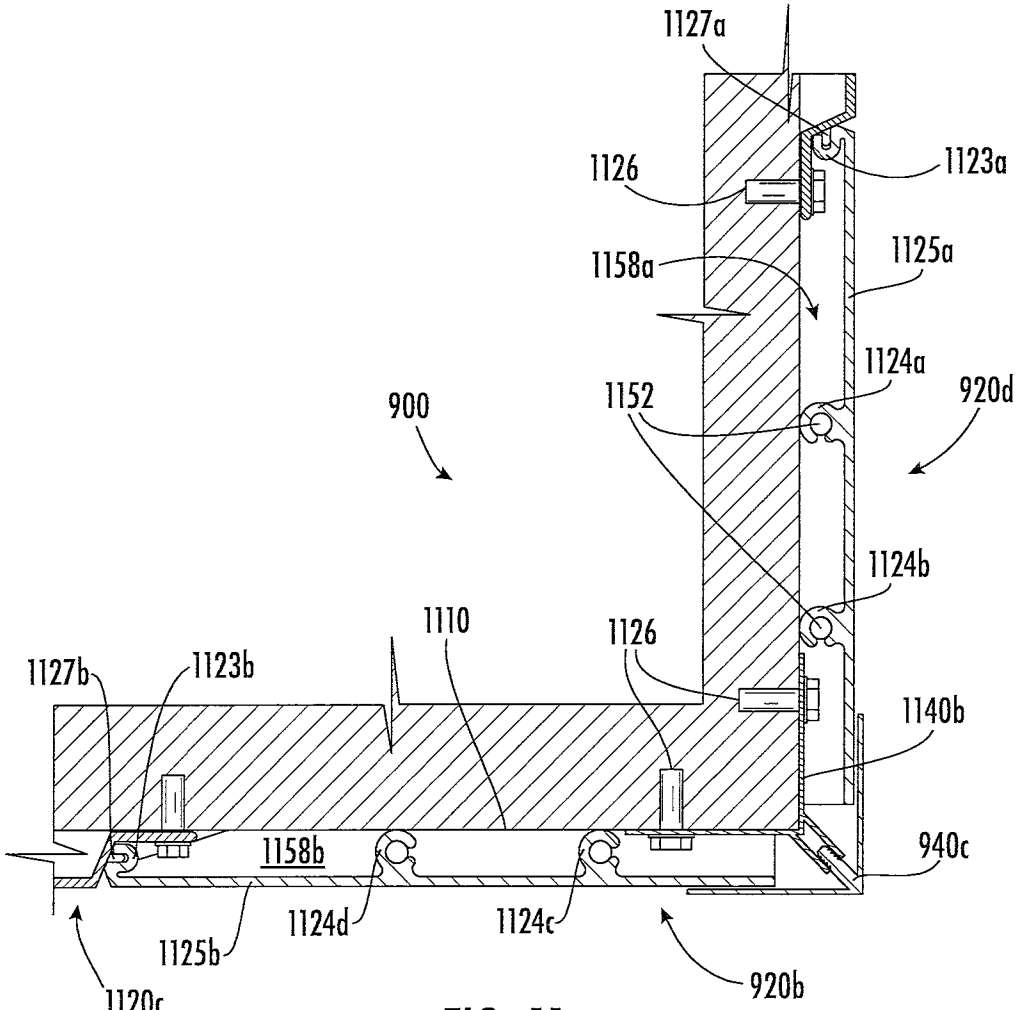
FIG. 11 is a top plan and partial section view taken along Section Line 11-11 of the preferred embodiment of a panel assembly, according to the present application.

Referring now also to FIG. 11 in the drawings, a panel assembly 1100 includes corner panel beams 1120*a*, 1120*b*, which are attached directly to wall 1110 using one or more sets of fasteners 1126. A first part 1140*a* of a two-part corner support encloses or seals the panel assembly by way of its connection to the second part 1140*b* of the two-part corner support. The panel assembly 1100 further includes multiple curved clip members 1124*a*, 1124*b*, 1124*c*, and 1124*d*, receiving ends 1123*a*, 1123*b*, and inserting ends 1127*a* and 1127*b*. Posts 1152 of respective end caps are visible in the section view as inserted into the clip member supports 1124.

Referring now to FIG. 12 in the drawings, an exploded view of a J-trim border support 1040 is depicted. J-trim border support 1040 includes a clip member 1224 and a first body portion 1225*a* of the support connected to a hidden flange 1211 of the support. First body 1225*a* includes two attachment flanges 1226*a* and 1226*b*. Flanges 1226*a* and 1226*b* are connected together to form an opening 1230 for receiving stud 1252 of hidden flange 1211. Stud 1252 is serrated, has ridges, or includes other formations for securing the stud within opening 1230 between attachment flanges 1226*a* and 1226*b*. Body 1225*a*, or a portion thereof, is connected orthogonally to flanges 1226*a* and 1226*b*.

Referring now to FIG. 13 in the drawings, a single-piece J-trim border support 1340 is depicted. Border support 1340 includes a clip member opening 1330. Border support 1340 includes a body portion 1325 connected to two parallel flanges 1311 and 1321. Border support 1340 may be formed by folding a single aluminum sheet with increasingly larger portions. For example, body portion 1325 is folded to have a dimension of A, first flange 1326*a* is folded to have a dimension B, where B is three times larger than A, and second flange 1326*b* has a dimension of C, which is five times larger than A.

Referring now to FIG. 14 in the drawings, an exploded view of the corner support 1140 is depicted. Border support 1140 includes a hidden corner portion 1411, a visible corner portion 1421, and three clip member openings 1430*a*, 1430*b*, and 1430*c*. The clip member openings 1430 are formed by multiple hidden fastener flanges 1426*a*, 1426*b*, 1426*c*, and 1426*d*, two of which receive a stud 1452. The surfaces of fastener flanges 1426 have at least one fastener, groove, serration, or other fastening device formed or attached thereto. Preferably, both parts of the border support 1140 are formed by extrusion. Alternatively, die-cast molding and other methods may be used to form border support 1140.

Referring now also to FIGS. 15 and 16 in the drawings, exploded views of alternative single-piece corner supports 1540 and 1640 are depicted. Corner supports 1540 and 1640 each include hidden surface portions 1511 and 1611, visible surface portions such as bodies 1525 and 1625, and clip member openings 1530*a*, 1530*b*, although the clip member openings for border support 1640 are not depicted because they are relatively small. FIG. 16 does, however, depict clip members 1624*a* and 1624*b*, which are formed by folding respective ends of the single sheet of aluminum onto themselves. Although not depicted, the folds of the folded ends may have cut-outs, anchors, or other features that interface with fasteners, such that after assembly, the folded ends attach to slide over, or otherwise hide the fasteners from view.

Figure 17A:
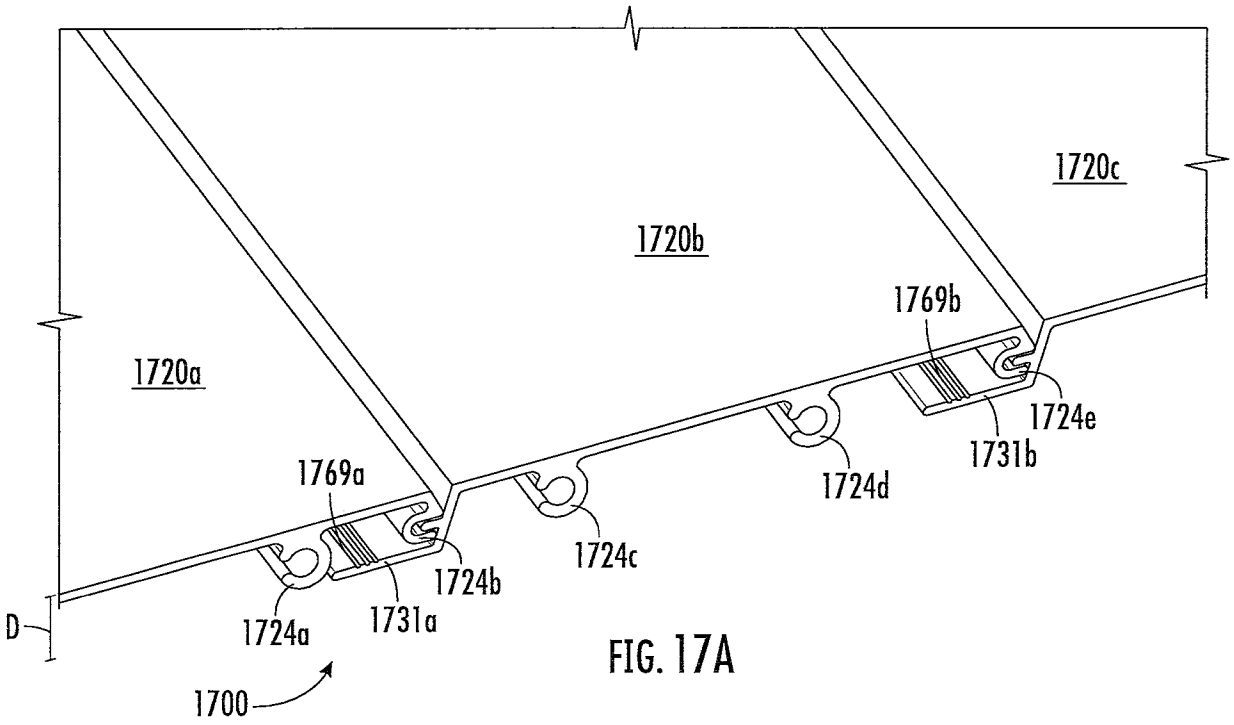
FIG. 17A is a perspective view of a preferred embodiment of panel beams, according to the present application.
Figure 17B:
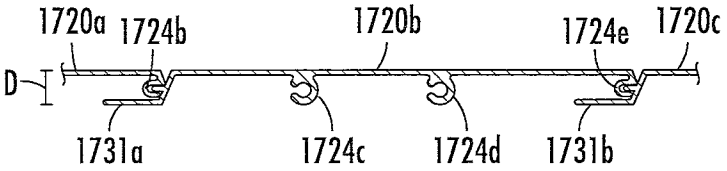
FIG. 17B is a top plan view of the panel beams of FIG. 17A.
Figure 19:
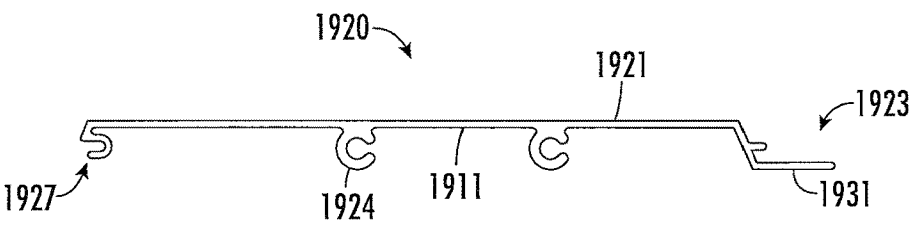
FIG. 19 is a top plan view of an alternative embodiment of a face of a panel beam, according to the present application.
Figure 21:
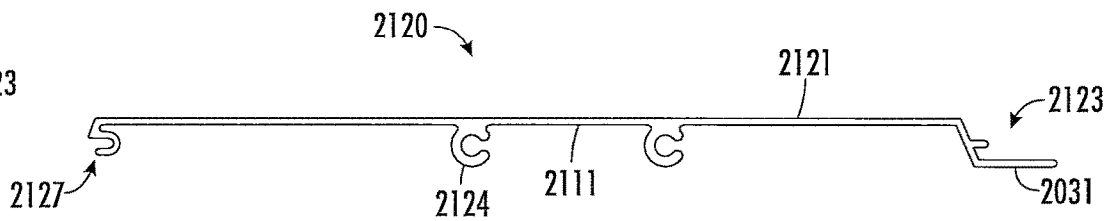
FIG. 21 is a top plan view of an alternative embodiment of a face of a panel beam, according to the present application.
Figure 18:
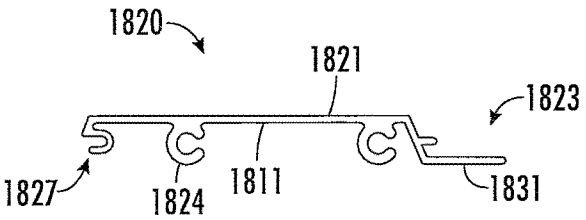
FIG. 18 is a top plan view of an alternative embodiment of a face of a panel beam, according to the present application.
Figure 20:
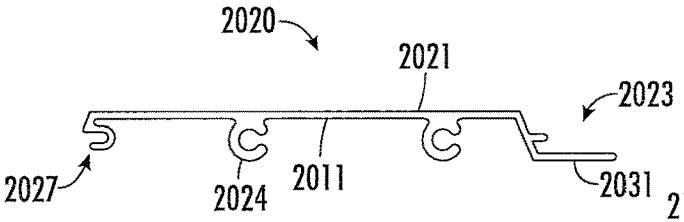
FIG. 20 is a top plan view of an alternative embodiment of a face of a panel beam, according to the present application.

It is important to note that at least FIGS. 13, 14, and 15 depict a border support having a dimension, A. Referring now to FIGS. 17A and 17B, the beams of a panel assembly 1700 have a dimension, D, which corresponds to the dimension, A. Preferably, dimension A is exactly equivalent to dimension D, ensuring a water-proof or at least water-resistant seal is formed between the supports. Alternatively, dimension A is slightly larger than dimension D. For example, dimension A may be less than or equal to a depth that is about 7-15% larger than a depth of dimension D. Beam supports 1720*a*, 1720*b*, 1720*c*, of panel assembly 1700 are formed similar to supports of panel assembly 100, except that attachment tabs 1731*a*, 1731*b* have respective grooves 1769*a* and 1769*b* formed therein. Grooves 1769*a*, 1769*b* are formed to help provide flexibility to attachment tabs 1731*a*, 1731*b*, but may also help direct water flow from condensation, receive fasteners for securing the tabs to a support substrate, reduce amounts of material required for beam formation, provide aesthetic appeal, or provide other combinations of beneficial purposes.

Because extruded panel beams can be formed and cut at the job-sit, or in the shop, according to any desired dimension, there is a significant reduction in waste from forming panel assemblies from the panel beams. For example, a panel beam can be formed to the precise length needed, and together with screw bosses, and attachment ends of the panel beams, there is no need to cut the beams into wasteful segments. Screw bosses at the ends of panel beams enable joining two different panel beams through the use of threaded studs inserted between two different screw bosses of the two different beams to form a near-seamless, very long panel beam.

Referring now to FIGS. 18-21 in the drawings, panel supports 1820, 1920, 2020, and 2120, each having at least one different dimension relative to another, are depicted. For example, a latitudinal width of panel support 1820 may be three inches, while the respective latitudinal widths of panel supports 1920, 2020, and 2120 are six, four, and eight inches. In a preferred embodiment, each of panel supports 1820, 1920, 2020, and 2120 have the same depth dimensions so that panel supports that are multiples of each other may be used in the same panel design. Alternatively, panel supports 1820, 1920, 2020, and 2120 have different depth dimensions, however, despite differing dimensions, preferably only panel beams having the same depth dimensions are used together in the same panel design. It is important to note that panel supports 1820, 1920, 2020, and 2120 are similar in that they each have respective hidden surfaces 1811, 1911, 2011, 2111, visible surfaces 1821, 1921, 2021, 2121, clip members 1824, 1924, 2024, 2124, receiving ends 1823, 1923, 2023, 2123, inserting ends 1827, 1927, 2027, 2127, and attachment tabs 1831, 1931, 2031, 2131.

Figure 22:
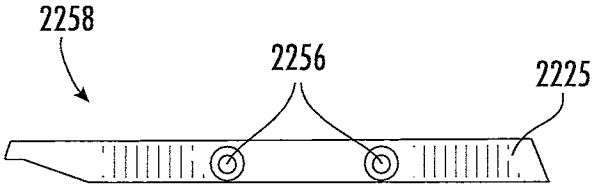
FIG. 22 is a top plan view of an end cap, according to the present application.

Referring now to FIG. 22 in the drawings, a panel beam end cap 2258 is depicted. End cap 2258 includes one or more posts 2256 attached to a rectilinear body 2225 that is shaped similar to a perimeter of a face of a panel beam, such as face 50 or face 150. One or more posts 2256 are preferably attached at a 90° angle, or normal, to body 2225. Alternatively, the posts are connected to the body at an angle of about 1° to 10°.

Figure 23A:
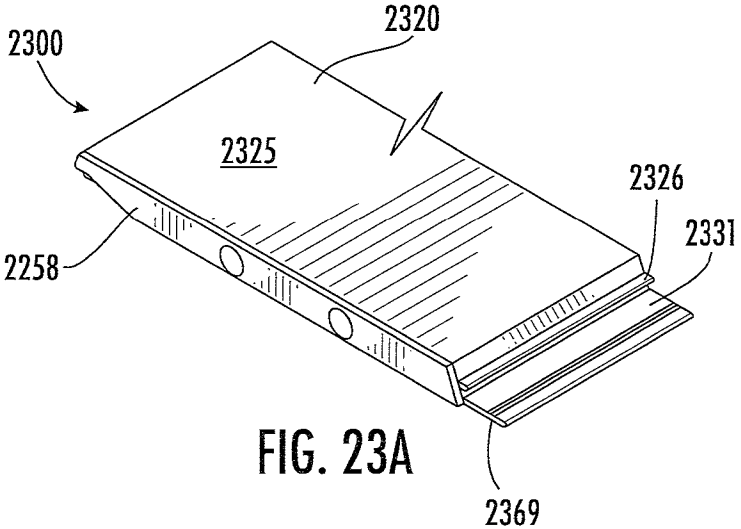
FIG. 23A is a perspective view of an alternative embodiment of an end of a panel beam, according to the present application.
Figure 23B:
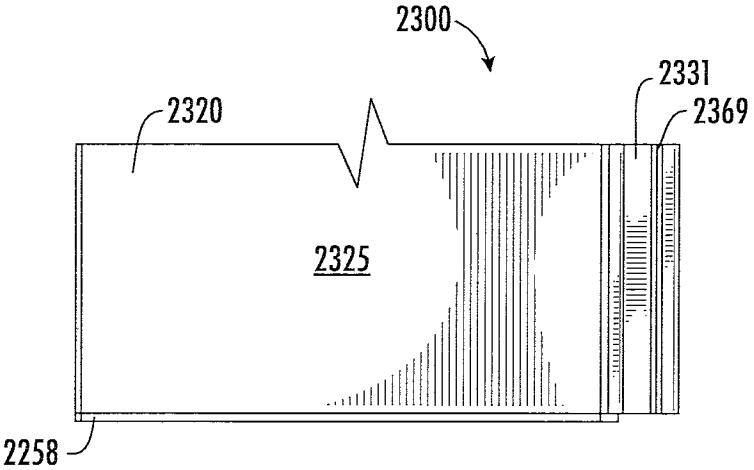
FIG. 23B is an elevation side view of the end of the panel beam of FIG. 23A.

Referring now also to FIGS. 23A and 23B in the drawings, a panel assembly 2300 includes a panel beam support 2320 having end cap 2258 attached to an end of the beam support. Panel support 2320 includes body surface 2325, fastener flange 2326, and attachment tab 2331, where attachment tab 2331 includes multiple grooves 2369 formed therein. Although not depicted, panel support 2320 also includes clip members into which the one or more posts 2256 of end cap 2258 are inserted.

It is important to note that end cap 2258 can be interchanged with a second similarly shaped, or differently shaped end cap. The interchanging also enables changing the aesthetics, such as by making the color of the end cap the same or different than the beams of the panel assembly. A width dimension of the exposed surface of the end caps also make joints and panel beam ends cleaner, with reduced gaps and reduced waste.

Figure 24A:
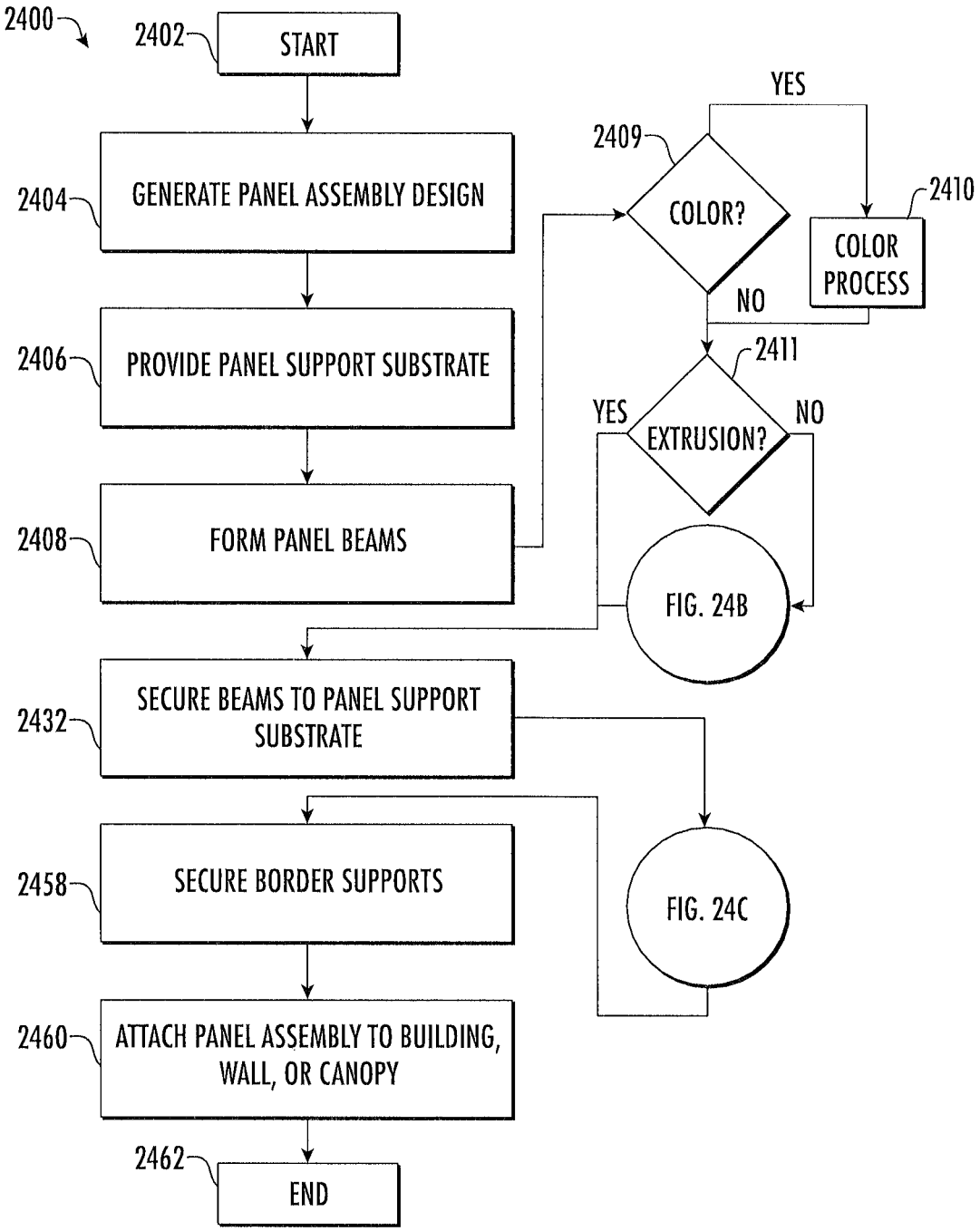
FIGS. 24A-24C are flow charts depicting a process for assembling a panel assembly according to an embodiment of the present application.
Figure 24B:
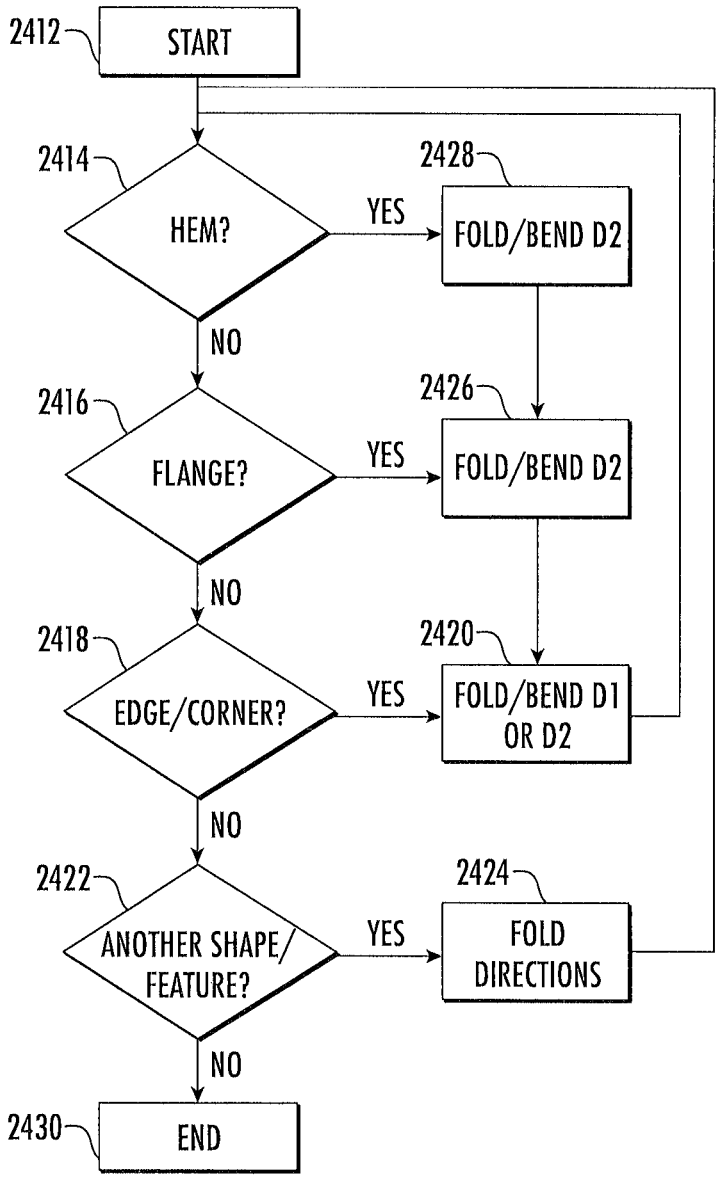
Figure 24C:
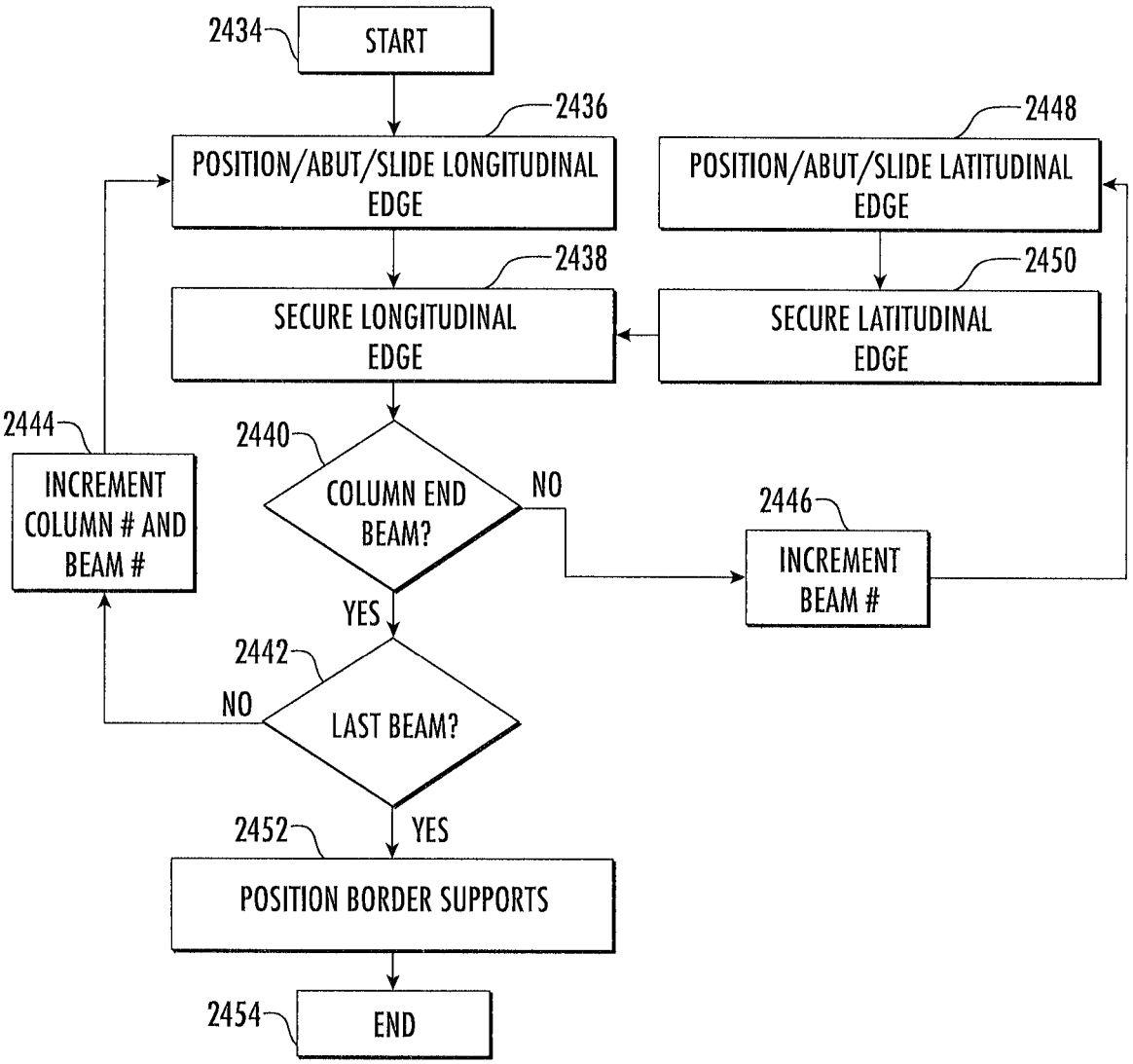

Referring now also to FIGS. 24A-24C in the drawings, methods for making a panel assembly, such as assembly 100 as displayed in FIG. 3, are illustrated according to a preferred embodiment of the present application. It should also be understood that some embodiments of a panel assembly may be made out of pieces of substantially rectilinear sheet metal or extruded panel beams.

At Step 2402, a method 2400 starts by providing computer software, hardware, folding machines, raw materials, and other resources necessary for the formation of the panel assembly.

Step 2404 includes generating a panel design, which includes assigning a beam number or count to each beam. For example, a column number and beam number may be assigned. Preferably, the panel design is generated using computer software, such as a CAD program. Step 2404 includes determining longitudinal and latitudinal dimensions of beams. These determinations are made based on federal regulations, industry guidelines, or municipal code if the panel assembly is used for structural support. Alternatively, these determinations are made based on an aesthetic appeal. Step 2404 further includes ensuring a seam of a column of panel beams in the design does not align at least with a seam in the iteratively next column of panel beams. Alternatively, step 2404 includes ensuring seams do align, based on aesthetic preferences, panel design, or designer/manufacturer preference.

Step 2406 includes providing a panel support substrate that will support each of the multiple panel beams used in the design generated in Step 2404. The support substrate is also configured to attach each panel beam. Step 2406 includes determining an appropriate material composition for the panel support substrate. For example, wood may be used if fasteners include wood screws and the panel assembly will remain indoors or will be substantially covered (i.e., when it is used together with a canopy). Alternatively, cinder block, brick, or aluminum or another lightweight, rigid material such as carbon fiber, titanium, or steel tubing, is provided as the panel support substrate.

Step 2408 includes forming the panel beams. Step 2408 includes an initial determination 2409 as to whether or not the panel beams need coloring. At Step 2409 the determination is made that the beams need coloring. As the preferred material composition is aluminum, Step 2408 may include an additional coloring process 2410. For example, Step 2410 may include anodizing the aluminum used to form the beam panels and then dyeing or adding pigment during the anodizing process. Alternatively, an alloy is added during the beam formation, which may add a desired characteristic, such as color, strength, ductility, or combinations thereof, to the panel beam. In at least one embodiment, other coloring techniques are used, such as a topical application, such as enamel, or an electrolytic coloring (EC) process. It is noted that the border support beams are colored the same, or different than, the panel beams depending on the design or aesthetic appeal desired.

At Step 2411, the determination is made that the beams are formed using extrusion. The process then jumps to Step 2432.

Returning to Step 2409, the determination is made that no coloring is necessary. Returning to Step 2411, the determination is made that the beams are not formed using extrusion. For example, the panel beams are made of aluminum sheet metal using a folding or bending process.

Referring now to FIG. 24B in the drawings, Step 2412 begins the folding or bending sub-process by, for example, turning on and initializing a folding machine. It is important to note that an automated folding machine, a manual brake press, or combinations thereof, may be used to fold or bend the sheet metal to form the panel beams. As such is the case, a plurality of folds or bends are made in a piece of sheet metal, thereby forming each beam.

Step 2412 includes calibrating a machine to perform the plurality of folds or bends. This may include entering machine parameters, including but not limited to, entering and/or determining a material thickness, a bend allowance, a moment of bending, a floated radius, and a die opening. The calibration may include making initial bends to create a flat blank, adjusting measurements and parameters while making the blank, and then recording finalized measurements and parameters. It is noted that portions of Step 2412 may be performed using machine learning, artificial intelligence, and predictive analysis. Such techniques may make using different materials, material thicknesses, and design geometries faster, easier, and less costly.

Step 2414 includes determining whether the most complicated feature of the panel beam is being formed. For example, step 2414 includes determining whether a hem, which has the highest number of folds, will be made.

At Step 2416 it is determined that a hem is not being formed. Step 2416 includes determining whether the second most complicated feature is being formed. For example, a flange may require only two folds.

At Step 2416 it is determined that a flange is not being formed. Step 2418 includes determining whether the least complicated feature is being formed. For example, an edge or a corner may require only a single fold.

At Step 2418 it is determined that a corner is being formed. Thus, Step 2420 includes performing a fold by moving the folding bar in a first direction, D1, which for 90-degree corners, results in a bending angle of 90 degrees and an opening angle of 90 degrees. A wiper tool may be used to form the corner.

Returning to Step 2418, it is determined that an edge is being formed. Thus Step 2420 includes performing a fold by moving the folding bar in second direction, D2, or the first direction, D1, depending on the design, previous fold, and the type of folding machine being used. A panel bender, folding tool, or rotary tool may be used to form edges.

Returning to Step 2418, the determination is made that an edge is not being formed. Step 2422 includes determining whether another feature or shape will be formed. Step 2424 includes following instructions, such as pre-programmed or written instructions, for forming the other shape and/or feature.

Returning to Step 2414, the determination is again made that a hem is not being formed. Returning to Step 2416, the determination is mad that a flange is being formed. Since a flange requires two folds, the first in one direction, D2, and the second in an opposite direction, D1, the method proceeds to Step 2426 and then returns to Step 2420 again.

Returning to Step 2414, the determination is made that a hem is being formed. Because a hem requires at least three folds, with a first fold being in a first direction, D2, the second being in substantially the same direction, D2, and the third being in an opposite direction, D1, the method proceeds to Step 2428, returns to Step 2426, and then returns to Step 2420.

Returning to Step 2422, the determination is made that another shape and/or feature is not being formed, or that there is no instructions for forming the other shape and/or feature. At Step 2430, the sub-process ends.

Returning again to FIG. 24A in the drawings, Step 2432 includes securing panel beams to the panel support substrate.

Referring now to FIG. 24C in the drawings, Step 2434 begins the sub-process of securing panel beams to the panel support substrate. Step 2434 includes any preparation of the panel support substrate that is necessary, such as attaching hooks, painting, preparing, finishing, cutting, and combinations thereof.

Step 2436 includes determining the beam number or count assigned at Step 2404, when the design is generated.

At Step 2436, a portion of the first beam of the design is positioned on the panel support substrate. For example, a longitudinal edge or flange to the panel support substrate may be slid onto the panel support substrate into place.

At Step 2438, the first portion of the first beam is secured. For example, the longitudinal edge may be secured using fasteners. Preferably, in the first iteration of the assembly cycle, threaded fasteners secure an attachment tab to the panel support substrate. In a subsequent iteration of the assembly cycle, fastener flanges are snapped or interlocked into place with a receiving end of a previously positioned panel support.

At Step 2440, the determination is made that the beam is the end beam for its respective column. For example, the single beam 220*a* depicted in FIG. 3 is the only beam in its column.

At Step 2442, the determination is made that the column number and beam number associated with the panel beam do not indicate it is the last beam in the panel assembly design.

At Step 2444, both the column number and the beam number for the placement instructions, machine, or manufacturer, are incremented. The sub-process then cycles back through Steps 2436 and 2438, placing a longitudinal edge of another beam, sliding the next beam of the next column into place, and securing the longitudinal edge of the next beam of the next column.

Returning to Step 2440, alternatively in the first phase of the cycle, the determination is made that the beam, based on its associated beam number and column number, is not the last beam in the column. For example, in FIG. 9A, beam 920*a* is not the last beam in the column of beams. At Step 2446, the beam number is incremented.

At Step 2448, the latitudinal edge of the subsequent beam (e.g., beam 920*b*) of the column is slid against the latitudinal edge of the previous beam of the column (e.g., beam 920*a*). At Step 2450, both edges abut one another as the latitudinal edge of the second beam is further slid into place and secured. For example, Step 2448 may include positioning a clip member along the latitudinal edge, and Step 2450 includes securing the latitudinal edge within the clip member. In at least one embodiment, Step 2450 includes securing the clip member. For example, clip member 224 of FIG. 5 may have its attachment tab 531 secured before moving on to the next step.

At Step 2438, a second portion of the subsequent beam is secured into place. For example, the longitudinal edge may be snapped into place using a fastening flange of the subsequent beam and a receiving end of a previous beam.

Returning again to Step 2440, the determination is made that the beam is the last beam in the column. Again, this determination is made using the associated beam number.

At Step 2442, the determination is made that the column number and beam number associated with the subsequent beam (e.g., beam 920*b*) does not indicate it is the last beam in the panel assembly design.

At Step 2444, both the column number and the beam number for the placement instructions, machine, or manufacturer, are incremented. The sub-process then cycles back through Steps 2436 and 2438, placing a longitudinal edge of another beam by abutting it within the receiving end (e.g., spaced-apart hem) of the previous column of panel beams (e.g., beams 920*a* and 920*b*), sliding the first beam of the second column into place, positioning the longitudinal edge in collinear alignment with the longitudinal edge of the first column of beam(s), and securing the longitudinal edge of the first beam of the second column in the receiving end of the previous column. These cycles continue until the last beam number and/or last column number are obtained.

Returning to Step 2452, the determination is made that the beam is the last or end beam in the design. At Step 2452, the border supports are positioned around the panel assembly.

At Step 2454, the sub-process of placing panel beams on the panel support substrate ends. This termination point triggers the next step in method 2400.

Returning again to FIG. 24A, at Step 2458, the border supports are secured. This includes placing flanged ends, or spaced-apart hems, of the longitudinal edges of the border supports within clip members, abutting the latitudinal edges of the panel beams. This may also include fitting the border support openings onto fastener heads and sliding the border supports down, such that the studs of the fasteners lock within the locking openings on the border supports. In at least one embodiment, the longitudinal edges of the border supports are placed on the panel support substrate, abutting the latitudinal edges of the panel beams with the longitudinal edges of the border support beams only after the border supports are slid onto the fasteners using their respective locking openings.

It is important to note that steps may be performed in a different order than indicated above and the resulting method and/or process still be encompassed in the Present Application. For example, in some embodiments, Step 2411 may occur before Step 2409, as the coloring process in Step 2410 may depend on an initial determination that an extrusion process will be used to form the panel beams.

Figure 25A:
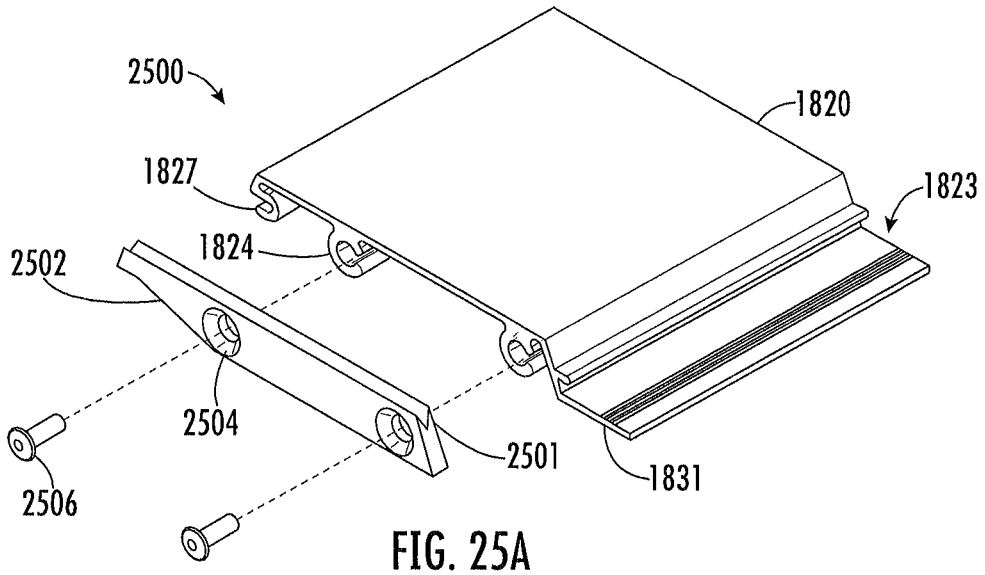
FIG. 25A is an exploded view of a panel assembly with an end cap, according to an embodiment of the present application.
Figure 25B:
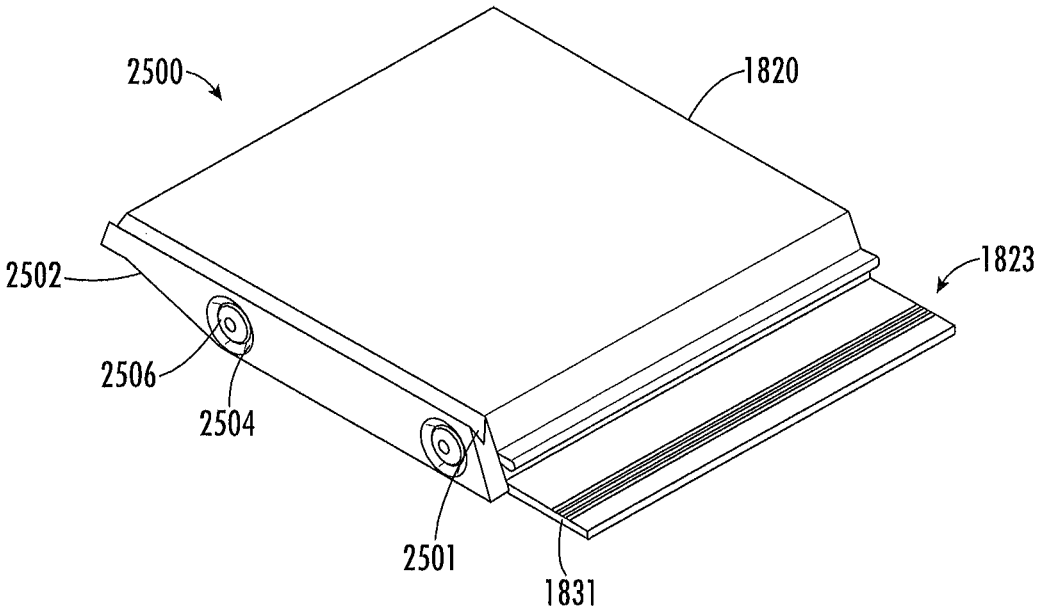
FIG. 25B is a perspective view of a panel assembly with an end cap, according to an embodiment of the present application.

Referring now also to FIGS. 25A and 25B in the drawings, a panel assembly with an end cap is illustrated. FIGS. 25A and 25B best illustrate an end cap 2502 for panel support 1820. It should be appreciated that different sizes and shapes can be used for end cap 2502, such that the end cap fits on different size panel supports. For example, panel supports 1920, 2020, and 2120 can be fitted with an end cap properly sized to cover the end of the panel support. It is preferred that end cap 2502 be formed by an extrusion process followed by cutting and other machining processes; however, end cap 2502 may be formed by other methods of manufacturing.

FIG. 25A best illustrates an exploded view of panel assembly 2500 prior to the end cap 2502 being connected. End cap 2502 has an end effect, a visual effect, which is defined by the configuration of the exposed surface of the end cap and the edges of the exposed surface. The edges of the exposed surface are defined by the intersection between the exposed surface and a side surface of the end cap. End cap 2502 preferably includes a V-shaped groove 2501 and a fastener hole 2504. It will be appreciated that other shapes for groove 2501 may be used, depending upon the desired end effect. While the Figures all show the end cap with a groove, it should be appreciated that it is possible for the end cap to have a flat surface rather than a groove. The groove provides extra definition to the end cap, but a smooth surface, whether flush with the panel assembly or recessed, can provide some level of definition by way of varying colors or other methods. A fastener 2506 is placed through fastener hole 2504 and into clip member 1824, such that end cap 2502 is secured in place on the end of panel support 1820. Under the preferred embodiment, fastener hole 250 is countersunk. However, it should be appreciated that the hole may vary, such as being counterbored or being flat. Clip member 1824 may be screw bosses that extend the entire length of panel support 1824. While it is preferred that clip member 1824 is c-shaped, it should be appreciated that other shapes may be used, such as a full circle shape.

While it is preferred that rivets are used for fastener 2506 to attach end cap 2502 to panel support 1820, it should be appreciated that other methods of fastening may be used, such as screws, bolts, or some kind of adhesive. FIG. 25B best illustrates panel assembly 2500 after the fasteners 2506 are in place and end cap 2502 is secured to panel support 1820. It should be appreciated that the depth of V-shaped groove 2501 may vary in size and shape, although the groove must not go below a depth that would cause internal exposure when multiple panel assemblies are connected. For example, a U-shaped groove, a flat recessed groove/channel, or a solid surface could be used in place of a v-shaped groove. Although the Figures illustrate the groove beginning at the edge of the exposed surface of the end cap 2502, it should be appreciated that there may be some portion of end cap 2502 that remains flat. Additionally, rather than using a fastener to connect the end cap to the panel support, alternative embodiments may use other methods of connection for securing multiple pieces together. For example, multiple panel supports may be connected, with an end cap in between, by the use of a tapered pin (not shown) running through a screw boss of each respective panel, and through a hole in the end cap.

End cap 2502 preferably has a mill finish, such that no untreated panel material is exposed when the panel assembly 2500 is fully connected. It should be appreciated that end cap 2502 may be alternative colors, textures, or have alternative treatments, to achieve a desired visual effect of the finished assembly. For example, the end cap may be colored so as to create the look of the end of a real wood board.

It should be appreciated that end cap 2502 preferably extends from the substrate to the outer surface of the panel assembly, thereby creating enclosures instead of having long gaps where air can freely flow. By eliminating lengthened gaps, a fire stop is created, and there is a potential for an increased fire rating due to the inclusion of the end caps. Another unique advantage of end cap 2502, is that the gap between individual panels of the panel assembly and the substrate are hidden from external viewing. By covering the gap and the substrate with end cap 2502, any unsightly portions of the interior of the panel assembly and wall substrate are hidden. By using the end cap to hide interior portions of the panel assembly, the raw aluminum edge is also covered, which eliminates the need for any touch up work after installation. The end cap 2502 also helps prevent oil canning of the panels, which may occur when multiple panels butt up against one another.

Figure 26A:
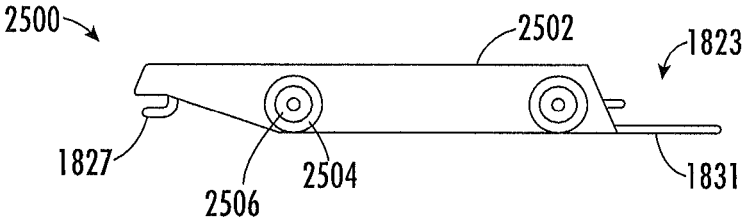
FIG. 26A is a front view of a panel assembly with an end cap, according to an embodiment of the present application.
Figure 26B:
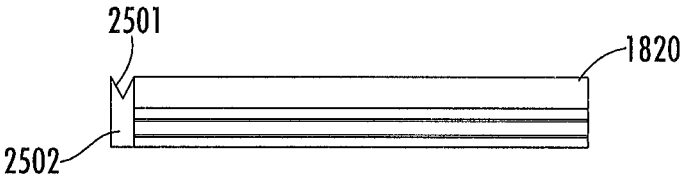
FIG. 26B is a side view of a panel assembly with an end cap, according to an embodiment of the present application.
Figure 26C:
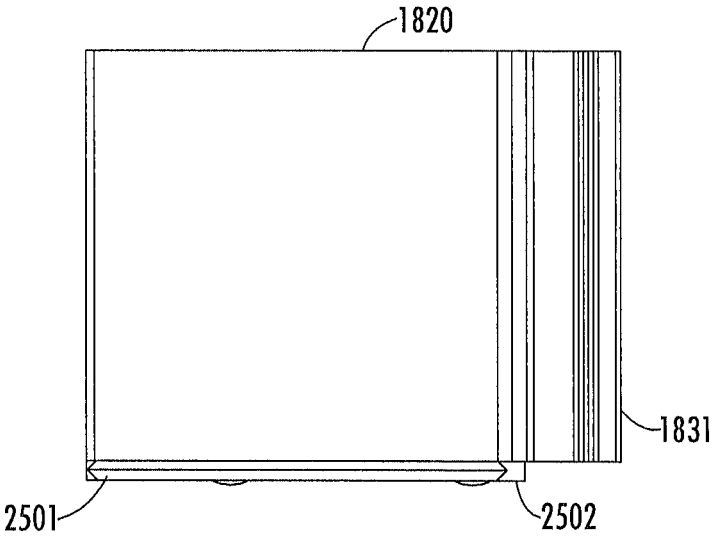
FIG. 26C is a top view of a panel assembly with an end cap, according to an embodiment of the present application.

Referring now also to FIGS. 26A-26C in the drawings, a panel assembly with V-shaped groove end cap is illustrated. FIG. 26A best illustrates the positioning of end cap 1502 when assembled, such that inserting end 1827 may still be attached to receiving end 1823 when multiple panel supports are connected together. FIG. 26B best illustrates the depth of the V-shaped groove 2501. FIG. 26C best illustrates the seated positioning of the bottom of V-shaped groove 2501, such that it lines up with the bottom of the vertical V-shaped grooves that appear between panels when multiple vertical panels are fixed adjacently. The depth of the V-shaped groove 2501 should not go below the illustrated depth, as further depth would result in exposed portions of the unfinished panel material. The unique configuration of the grooved portion provides visual definition in between vertical panel segments. To further enhance the visual effects of the end cap, the end cap may include lighting elements (not shown). For example, a strip/wafer of LED lights could be placed within a groove of the end cap. Additionally, the end cap may have a lip extending from the edge, such that a light could be placed on the inside of the lip and keeping the light from being directly exposed to the exterior.

Figure 27A:
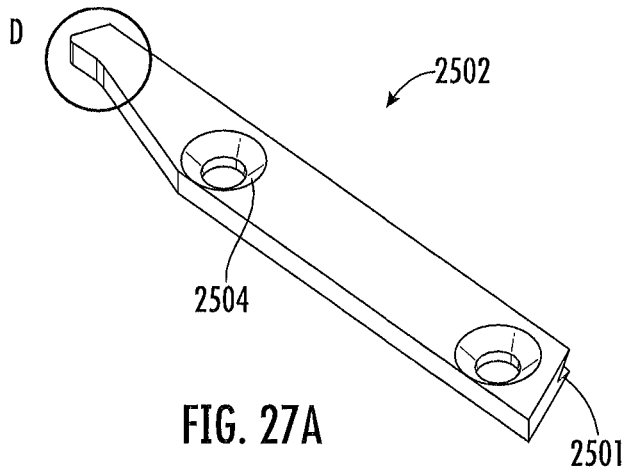
FIG. 27A is a perspective view of an end cap, according to an embodiment of the present application.
Figure 27B:
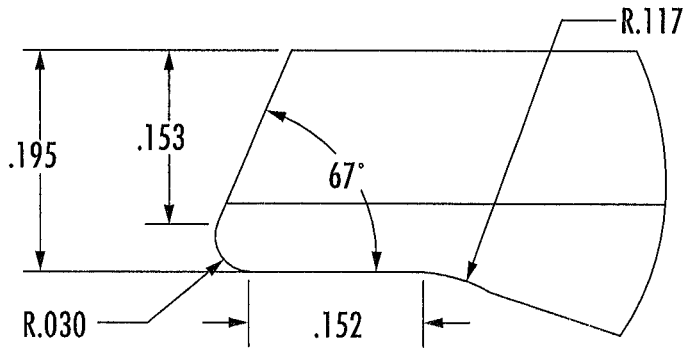
FIG. 27B is an enlarged view of detailed section D of the end cap of FIG. 27A.

Referring now also to FIGS. 27A and 27B, an end cap is illustrated. FIG. 27A best illustrates a different perspective view of end cap 2502, mainly distinguishing the fastening holes 2504 and the V-shaped groove 2501. FIG. 27B best illustrates an enlarged view of detailed section D of FIG. 27A. The dimensions of detailed section D should be appreciated, as the dimensions allow for inserting ends 1827 to remain unimpeded when end cap 2502 is attached to panel support 1820.

It is apparent that an invention with significant advantages has been described and illustrated. Although the present application is shown in a limited number of forms, it is not limited to just these forms, but is amenable to various changes and modifications without departing from the spirit thereof.

What is claimed is:

1. An end cap for a panel support of a panel assembly, the panel support having at least one clip member disposed on an interior surface of the panel support, the end cap comprising:

an exposed surface having opposing edges, the exposed surface forming a selected end effect that remains visible when the end cap is installed on the panel assembly; and a first side surface and a second side surface having at least one fastener hole extending from the first side surface to the second side surface, both the first side surface and the second side surface being generally planar;

wherein the end cap is configured to contact a surface behind the panel support, such that a gap between the panel support and the surface is closed by the end cap when coupled to the panel support;

wherein the opposing edges of the exposed surface are configured to mate with an end surface of the panel support;

wherein the end cap is a generally planar piece of material with no pipes, conduit, or other projections extending from the end cap, such that no section of the end cap projects into or underneath the panel support; and wherein the at least one fastener hole corresponds to the at least one clip member, such that when a fastener is secured through the at least one fastener hole and into the at least one clip member, an open-air portion of the panel support is closed off on an end where the end cap is disposed.

2. The end cap of claim 1, wherein the at least one fastener hole is countersunk.

3. An end cap for a panel support of a panel assembly, the panel support having at least one clip member disposed on an interior surface of the panel support, the end cap comprising:

an exposed surface having opposing edges, the exposed surface forming a selected end effect that remains visible when the end cap is installed on a panel assembly; and a first side surface and a second side surface having at least one fastener hole extending from the first side surface to the second side surface, both the first side surface and the second side surface being generally planar;

wherein the selected end effect of the exposed surface is a V-shaped groove;

wherein the opposing edges of the exposed surface are configured to mate with an end surface of the panel support;

wherein the end cap is a generally planar piece of material; and wherein the at least one fastener hole corresponds to the at least one clip member, such that when a fastener is secured through the at least one fastener hole and into the at least one clip member, an open-air portion of the panel support is closed off on an end where the end cap is disposed.

4. The end cap of claim 1, wherein the selected end effect of the exposed surface is a flat surface.

5. The end cap of claim 1, wherein the end cap is the same color as the panel support of the panel assembly.

6. The end cap of claim 1, wherein the end cap is a different color than the panel support of the panel assembly.

7. The end cap of claim 1, wherein the exposed surface of the end cap and the first side surface of the end cap have a mill finish.

8. The end cap of claim 1, wherein the fastener is a countersunk rivet.

9. The end cap of claim 1, wherein the fastener is a rivet.

10. The end cap of claim 1, wherein the fastener is a countersunk screw.

11. The end cap of claim 1, wherein the fastener is a pin.

12. The end cap of claim 1, wherein the end cap is shaped and configured to cover exposed end surfaces of the panel support.

13. The end cap of claim 1, wherein the end cap is shaped and configured to represent a machined gap between the panel support and a second adjoining panel support.

14. The end cap of claim 1, wherein the end cap is configured to reduce the length of air gaps in the panel assembly, such that the end cap is a fire stop.

15. The end cap of claim 1, wherein the end cap is configured such that an interior portion of the panel support is hidden.

16. The end cap of claim 1, wherein the end cap is configured to prevent the panel support from butting up against an additional panel support, such that oil canning of the panel assembly is prevented.

17. A plurality of end caps for a plurality of panel supports of a panel assembly, each panel support having at least one clip member disposed on an interior surface of the panel support, each end cap comprising:

an exposed surface having opposing edges, the exposed surface forming a selected end effect that remains visible when each end cap is installed on the panel assembly; and a first side surface and a second side surface having at least one fastener hole extending from the first side surface to the second side surface, both the first side surface and the second side surface being generally planar;

wherein the end cap is configured to contact a surface behind the panel support, such that a gap between the panel support and the surface is closed by the end cap when coupled to the panel support;

wherein the opposing edges of the exposed surface are configured to mate with an end surface of at least one of the plurality of panel supports;

wherein each end cap of the plurality of end caps is a generally planar piece of material with no pipes, conduit, or other projections extending from the end cap, such that no section of the end cap projects into or underneath the panel support; and wherein the at least one fastener hole corresponds to the at least one clip member, such that when a fastener is secured through the at least one fastener hole and into the at least one clip member, an open-air portion of the panel support is closed off on an end where the end cap is disposed.

18. The plurality of end caps of claim 17, wherein at least one of the end caps is visually distinct as compared to other end caps of the plurality of end caps, such that a visual effect is established by the placement of the different end caps.

* * * * *